US011603179B2

(12) United States Patent
Poirier et al.

(10) Patent No.: US 11,603,179 B2
(45) Date of Patent: Mar. 14, 2023

(54) MARINE PROPULSION DEVICE AND METHODS OF MAKING MARINE PROPULSION DEVICE HAVING IMPACT PROTECTION

(71) Applicant: Brunswick Corporation, Mettawa, IL (US)

(72) Inventors: Randall J. Poirier, Fond du Lac, WI (US); Wayne M. Jaszewski, Jackson, WI (US); Jeremy J. Kraus, Mt. Calvary, WI (US); Derek J. Fletcher, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 27 days.

(21) Appl. No.: 17/370,638

(22) Filed: Jul. 8, 2021

(65) Prior Publication Data

US 2022/0266969 A1 Aug. 25, 2022

Related U.S. Application Data

(63) Continuation-in-part of application No. 17/185,289, filed on Feb. 25, 2021.

(51) Int. Cl.
*B63H 20/10* (2006.01)
*B63H 5/125* (2006.01)

(52) U.S. Cl.
CPC ..... *B63H 20/10* (2013.01); *B63H 5/125* (2013.01); *B63H 2005/1256* (2013.01)

(58) Field of Classification Search
CPC ..... B63H 21/21; B63H 1/14; B63H 21/12; B63H 23/04; B63H 2005/1258;
(Continued)

(56) References Cited

U.S. PATENT DOCUMENTS 2,213,520 A 9/1940 Gentry
3,462,102 A 8/1969 Rivers
(Continued)

FOREIGN PATENT DOCUMENTS

EP 1611007 8/2007
EP 1914161 4/2008
(Continued)

OTHER PUBLICATIONS

International Search Report and Written Opinion for International Application No. PCT/CA/2016/050308 dated Jun. 9, 2016.

*Primary Examiner* — Andrew Polay
(74) *Attorney, Agent, or Firm* — Andrus Intellectual Property Law, LLP

(57) ABSTRACT

A propulsion device for a marine vessel. A base is configured to be coupled to the marine vessel. A shaft includes an upper segment and a lower segment each extending along a length axis, wherein the upper segment is coupled to the base. A propulsor is coupled to the lower segment, where the propulsor is configured to propel the marine vessel in water. A shock absorber includes a resilient member that resiliently couples the upper segment and the lower segment together, where the resilient member dampens impact forces received at the lower segment and reduces transfer of the impact forces to the upper segment.

20 Claims, 17 Drawing Sheets

(58) Field of Classification Search
CPC ..... B63H 2025/425; B63H 20/007; B63H 20/10; B63H 20/106; B63H 20/08; B63H 5/125; B63H 2005/1256; B63B 1/125; B63B 35/38; B63B 79/10; B63B 35/613
See application file for complete search history.

(56) References Cited

U.S. PATENT DOCUMENTS

| | | | | |
|---|---|---|---|---|
| 3,809,343 | A | 5/1974 | Adams et al. | |
| 3,865,335 | A | 2/1975 | Roller et al. | |
| 3,874,318 | A | 4/1975 | Langley | |
| 3,995,579 | A | 12/1976 | Childre | |
| 3,999,500 | A | 12/1976 | Friedel et al. | |
| 4,008,680 | A | 2/1977 | Alexander, Jr. | |
| 4,294,186 | A | 10/1981 | Wardell | |
| 4,410,161 | A | 10/1983 | Booty | |
| 4,548,586 | A * | 10/1985 | Phillips, Jr. ..... | B63H 20/007 440/6 |
| 4,734,068 | A * | 3/1988 | Edwards ..... | B63H 20/007 440/63 |
| 4,875,656 | A | 10/1989 | Boede | |
| 4,911,398 | A | 3/1990 | DiIulio et al. | |
| 4,966,566 | A | 10/1990 | Baird | |
| 5,005,798 | A | 4/1991 | McCoy | |
| 5,022,609 | A | 6/1991 | Cranston | |
| 5,131,875 | A | 7/1992 | Lee | |
| 5,152,240 | A | 10/1992 | Fontanille | |
| 5,195,914 | A * | 3/1993 | Binversie ..... | F16F 9/48 188/284 |
| 5,277,630 | A | 1/1994 | Clark | |
| 5,499,792 | A | 3/1996 | Tamiso | |
| 5,639,272 | A * | 6/1997 | Henderson ..... | B63H 20/007 440/75 |
| 5,669,794 | A | 9/1997 | Knight et al. | |
| 5,941,742 | A | 8/1999 | Whitaker | |
| 6,142,841 | A | 11/2000 | Alexander, Jr. et al. | |
| 6,280,267 | B1 | 8/2001 | Griffith, Sr. et al. | |
| 6,325,685 | B1 | 12/2001 | Knight et al. | |
| 6,431,923 | B1 | 8/2002 | Knight et al. | |
| 6,592,412 | B1 | 7/2003 | Geil et al. | |
| 6,789,648 | B2 | 9/2004 | Cook | |
| 7,004,803 | B2 | 2/2006 | Ruffe | |
| 7,004,804 | B2 | 2/2006 | Bernloehr et al. | |
| RE39,032 | E | 3/2006 | Gonring et al. | |
| 7,150,662 | B1 | 12/2006 | Janitz | |
| 7,285,029 | B1 | 10/2007 | Janitz | |
| 7,294,029 | B1 | 11/2007 | Spaulding | |
| 7,305,928 | B2 | 12/2007 | Bradley et al. | |
| 7,399,211 | B1 | 7/2008 | Spaulding | |
| 7,510,450 | B1 | 3/2009 | Dresher | |
| 7,520,239 | B2 | 4/2009 | Bryham | |
| 7,753,745 | B2 | 7/2010 | Schey et al. | |
| 7,887,381 | B2 | 2/2011 | Brass et al. | |
| 7,946,243 | B1 | 5/2011 | Ulrich | |
| 8,011,982 | B1 | 9/2011 | Baier et al. | |
| 8,051,793 | B2 | 11/2011 | Ulgen | |
| 8,479,677 | B2 | 7/2013 | Bolline et al. | |
| 9,296,455 | B2 | 3/2016 | Bernloehr et al. | |
| 9,586,655 | B1 | 3/2017 | Butler | |
| 9,738,364 | B2 | 8/2017 | Abney | |
| 9,889,914 | B1 | 2/2018 | Ostrowsky | |
| 9,896,162 | B2 | 2/2018 | Mcclure | |
| 10,167,069 | B2 | 1/2019 | Houle et al. | |
| 10,220,926 | B1 | 3/2019 | Pelini | |
| 2005/0159053 | A1 | 7/2005 | Ruffe | |
| 2009/0227158 | A1 * | 9/2009 | Bernloehr ..... | B63H 20/08 440/63 |
| 2010/0032545 | A1 | 2/2010 | Bernloehr et al. | |
| 2010/0116967 | A1 | 5/2010 | Todd et al. | |
| 2010/0136857 | A1 | 6/2010 | Goudsmit | |
| 2017/0203823 | A1 | 8/2017 | Abney | |
| 2017/0341718 | A1 | 11/2017 | Zimmerman | |
| 2018/0057130 | A1 | 3/2018 | Houle et al. | |
| 2018/0334233 | A1 | 11/2018 | Vance | |

FOREIGN PATENT DOCUMENTS

| | | |
|---|---|---|
| EP | 2757037 | 7/2014 |
| EP | 2242678 | 11/2015 |
| EP | 2246252 | 5/2019 |
| JP | 2013100013 | 5/2013 |

* cited by examiner

MARINE PROPULSION DEVICE AND METHODS OF MAKING MARINE PROPULSION DEVICE HAVING IMPACT PROTECTION

CROSS REFERENCE TO RELATED APPLICATION

This application is a continuation-in-part of U.S. patent application Ser. No. 17/185,289, filed Feb. 25, 2021, which is incorporated herein by reference in its entirety.

FIELD

The present disclosure generally relates to stowable propulsors for marine vessels.

BACKGROUND

The following U.S. Patents provide background information and are incorporated by reference in entirety.

U.S. Pat. No. 6,142,841 discloses a maneuvering control system which utilizes pressurized liquid at three or more positions of a marine vessel to selectively create thrust that moves the marine vessel into desired locations and according to chosen movements. A source of pressurized liquid, such as a pump or a jet pump propulsion system, is connected to a plurality of distribution conduits which, in turn, are connected to a plurality of outlet conduits. The outlet conduits are mounted to the hull of the vessel and direct streams of liquid away from the vessel for purposes of creating thrusts which move the vessel as desired. A liquid distribution controller is provided which enables a vessel operator to use a joystick to selectively compress and dilate the distribution conduits to orchestrate the streams of water in a manner which will maneuver the marine vessel as desired.

U.S. Pat. No. 7,150,662 discloses a docking system for a watercraft and a propulsion assembly therefor wherein the docking system comprises a plurality of the propulsion assemblies and wherein each propulsion assembly includes a motor and propeller assembly provided on the distal end of a steering column and each of the propulsion assemblies is attachable in an operating position such that the motor and propeller assembly thereof will extend into the water and can be turned for steering the watercraft.

U.S. Pat. No. 7,305,928 discloses a vessel positioning system which maneuvers a marine vessel in such a way that the vessel maintains its global position and heading in accordance with a desired position and heading selected by the operator of the marine vessel. When used in conjunction with a joystick, the operator of the marine vessel can place the system in a station keeping enabled mode and the system then maintains the desired position obtained upon the initial change in the joystick from an active mode to an inactive mode. In this way, the operator can selectively maneuver the marine vessel manually and, when the joystick is released, the vessel will maintain the position in which it was at the instant the operator stopped maneuvering it with the joystick.

U.S. Pat. No. 7,753,745 discloses status indicators for use with a watercraft propulsion system. An example indicator includes a light operatively coupled to a propulsion system of a watercraft, wherein an operation of the light indicates a status of a thruster system of the propulsion system.

U.S. Pat. No. RE39032 discloses a multipurpose control mechanism which allows the operator of a marine vessel to use the mechanism as both a standard throttle and gear selection device and, alternatively, as a multi-axes joystick command device. The control mechanism comprises a base portion and a lever that is movable relative to the base portion along with a distal member that is attached to the lever for rotation about a central axis of the lever. A primary control signal is provided by the multipurpose control mechanism when the marine vessel is operated in a first mode in which the control signal provides information relating to engine speed and gear selection. The mechanism can also operate in a second or docking mode and provide first, second, and third secondary control signals relating to desired maneuvers of the marine vessel.

European Patent Application No. EP 1,914,161, European Patent Application No. EP2,757,037, and Japanese Patent Application No. JP2013100013A also provide background information and are incorporated by reference in entirety.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

The present disclosure generally relates to a propulsion device for a marine vessel. A base is configured to be coupled to the marine vessel. A shaft includes an upper segment and a lower segment each extending along a length axis, wherein the upper segment is coupled to the base. A propulsor is coupled to the lower segment, where the propulsor is configured to propel the marine vessel in water. A shock absorber includes a resilient member that resiliently couples the upper segment and the lower segment together, where the resilient member dampens impact forces received at the lower segment and reduces transfer of the impact forces to the upper segment.

The present disclosure further relates to methods for making propulsion devices for a marine vessel. In one embodiment, the method includes configuring a base for coupling to the marine vessel and coupling a shaft to the base, the shaft including an upper segment and a lower segment each extending along a length axis. The upper segment is coupled to the base. The method further includes coupling a propulsor to the lower segment, where the propulsor is configured to propel the marine vessel in water. The method further includes coupling the upper segment to the lower segment via a resilient member of a shock absorber, where the resilient member dampens impact forces received at the lower segment and reduces transfer of the impact forces to the upper segment.

In some embodiments according to the present disclosure, a helical spring resiliently couples the upper segment and the lower segment together, where the resilient member resists the length axes of the upper segment and the lower segment being non-parallel to each other, resists rotation of the lower segment relative to the upper segment, and dampens impact forces received at the lower segment and reduces transfer of the impact forces to the upper segment. A breakaway sleeve rigidly couples the upper segment and the lower segment, where the breakaway sleeve is configured to break when the impact forces received by the lower segment exceed a predetermined limit. The upper segment and the lower segment remain coupled together by the helical spring after the breakaway sleeve breaks.

Various other features, objects and advantages of the disclosure will be made apparent from the following description taken together with the drawings.

BRIEF DESCRIPTION OF THE DRAWINGS

The present disclosure is described with reference to the following Figures.

DETAILED DISCLOSURE

The present inventors have recognized a problem with bow thrusters presently known in the art, and particularly those that are retractable for storage. Specifically, within the context of a marine vessel having pontoons, there is insufficient clearance between the pontoons to accommodate a propulsive device, and particularly a propulsive device oriented to create propulsion in the port-starboard direction. The problem is further exacerbated when considering how marine vessels are trailered for transportation over the road. One common type of trailer is a scissor type lift in which bunks are positioned between the pontoons to lift the vessel by the underside of the deck. An exemplary lift of this type is the "Scissor Lift Pontoon Trailer" manufactured by Karavan in Fox Lake, Wis. In this manner, positioning a bow thruster between a marine vessel's pontoons either precludes the use of a scissor lift trailer, or leaves so little clearance that damage to the bow thruster and/or trailer is likely to occur during insertion, lifting, and/or transportation of the vessel on the trailer. As such, the present inventors have realized it would be advantageous to rotate the propulsor in a fore-aft orientation when stowed to minimize the width of the bow thruster. Additionally, the present inventors have recognized the desirability of developing such a rotatable propulsor that does not require additional actuators for this rotation, adding cost and complexity to the overall system.

Figure 1:
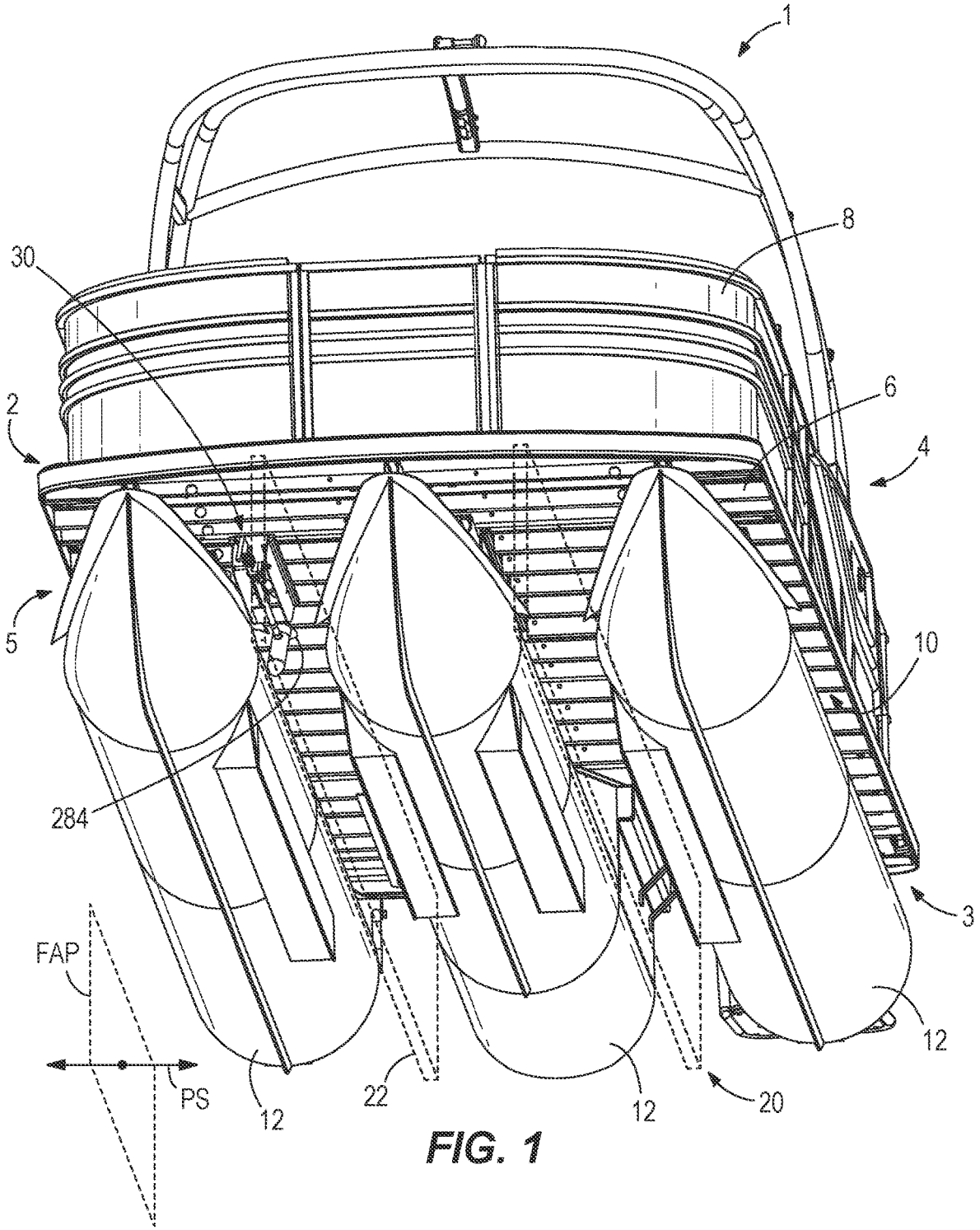
FIG. 1 is an isometric bottom view of a marine vessel incorporating a stowable propulsion device according to the present disclosure.

FIG. 1 depicts the underside of a marine vessel 1 as generally known in the art, but outfitted with an embodiment of a stowable propulsion device 30 according to the present disclosure. The marine vessel 1 extends between a bow 2 and a stern 3, as well as between port 4 and starboard 5 sides, thereby defining a fore-aft plane FAP, and port-starboard direction PS. The marine vessel 1 further includes a deck 6 with a rail system 8 on top and pontoons 12 mounted to the underside 10 of the deck 6. The marine vessel 1 is shown with a portion of a scissor type lift 20, specifically the bunks 22, positioned between pontoons 12 to lift and support the marine vessel 1 for transportation over land in a manner known in the art. As is discussed further below, embodiments of a novel stowable propulsion device 30 have a propeller 284 that faces the underside 10 of the deck 6 when stowed, in contrast to during use to propel the marine vessel 1 in the water as a bow thruster. This is distinguishable from propulsion devices known in the art, in which the propeller faces the pontoons. In prior art configurations, there typically is insufficient room between the propulsion device and the pontoons to fit the bunks of the scissor type lift without risking damage to the propulsion device while inserting the bunks, lifting the marine vessel, and/or traveling on the road.

Figure 2:
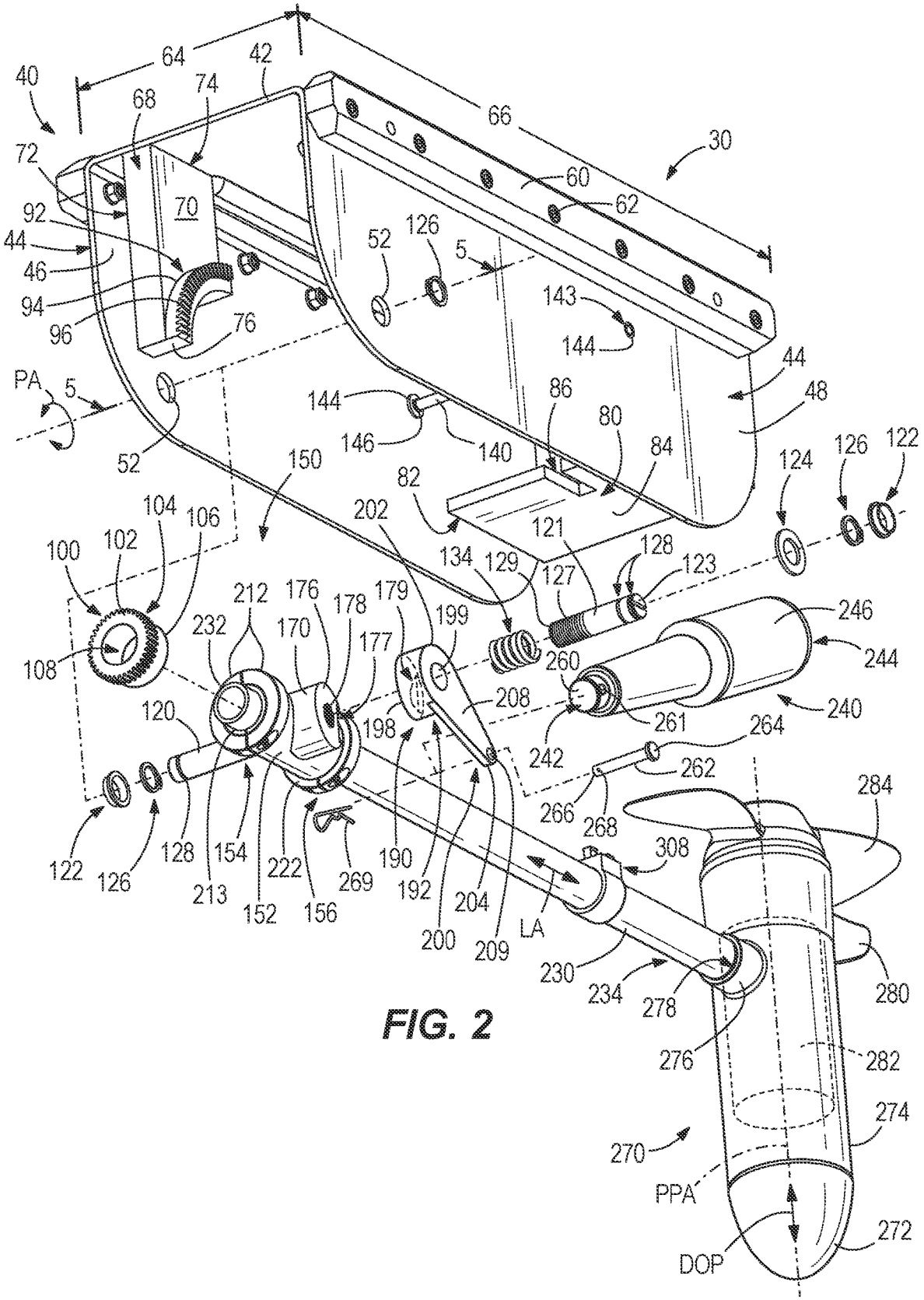
FIG. 2 is an exploded isometric view of a system such as that shown in FIG. 1 in a stowed position.
Figure 3:
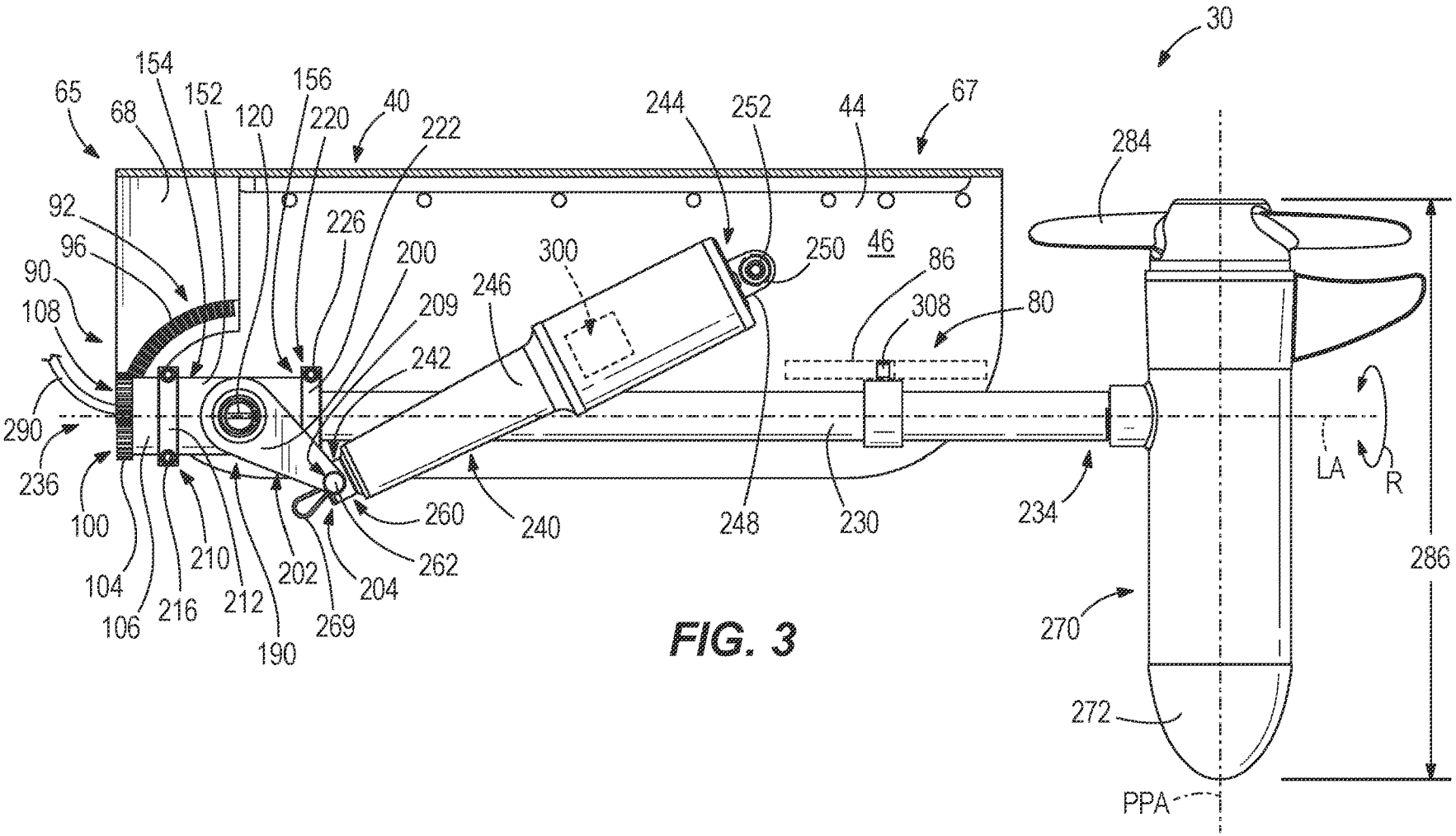
FIG. 3 is a sectional side view taken along the line 3-3 in FIG. 2.
Figure 4:
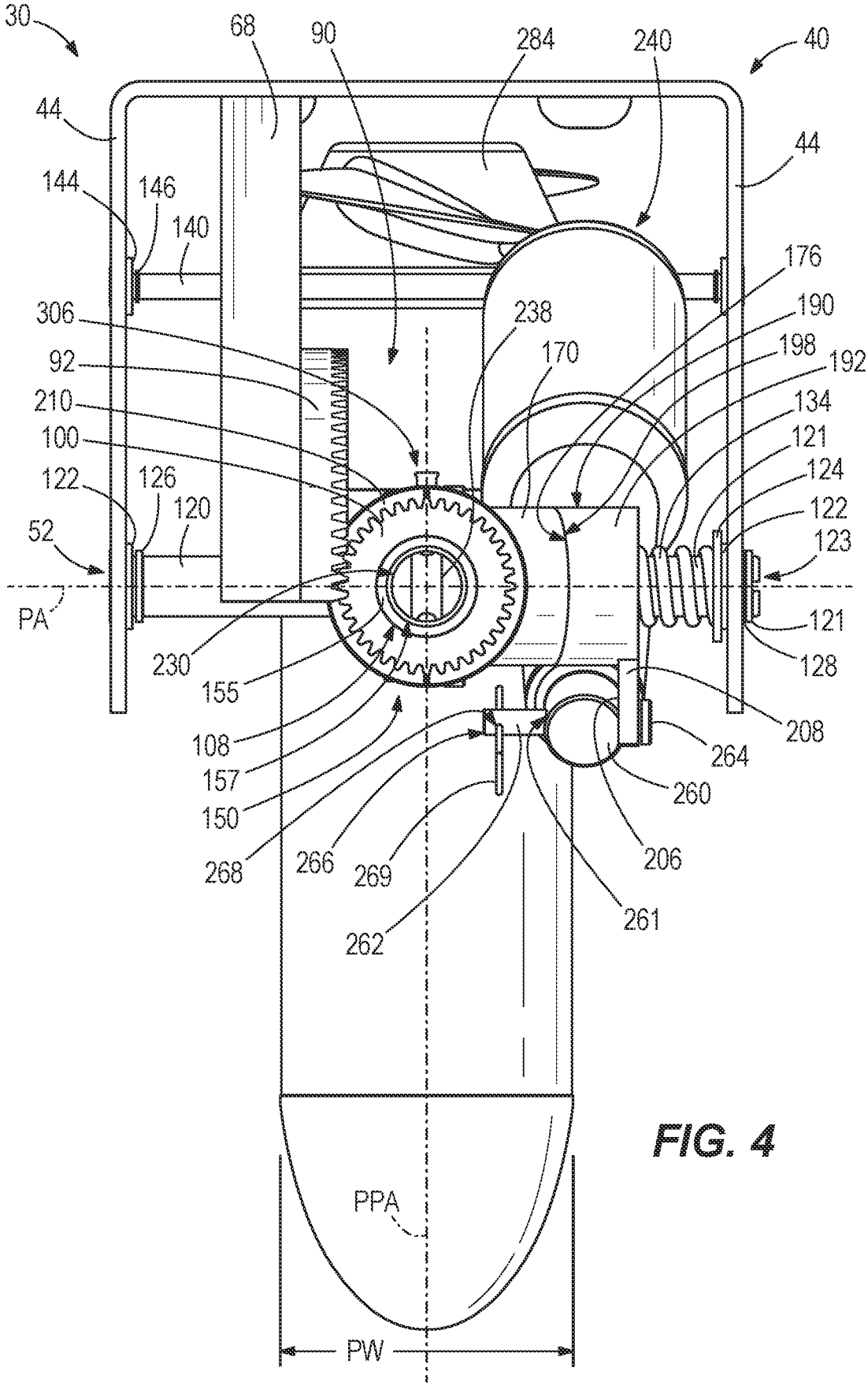
FIG. 4 is a rear view of the system shown in FIG. 2.

FIGS. 2-3 depict an exemplary stowable propulsion device 30 according to the present disclosure, here oriented in a stowed position. The stowable propulsion device 30 includes a base 40 having a top 42 with sides 44 extending perpendicularly downwardly away from the top 42. The sides 44 include an inward side 46 and outward side 48 and extend between a first end 65 and second end 67 defining a length 66 therebetween. A width 64 is defined between the sides 44. A stop 80 having sides 82 and a bottom 84 is coupled between the sides 44 of the base 40. A leg 68 having an inward side 70 and outward side 72 extends between a top end 74 and a bottom end 76. The leg 68 is coupled at the top end 74 to the top 42 of the base 40 and extends perpendicularly downwardly therefrom. A stationary gear 92 having a mesh face 96 with gear teeth and an opposite mounting face 94 is coupled to the leg 68 with the mounting face 94 facing the inward side 70 of the leg 68. As shown in FIG. 4, one or more support rods 140 may also be provided between the sides 44 and received within support rod openings 143 defined therein to provide rigidity to the base 40. In the example shown, the support rod 140 is received within a bushing 144 and held in position by a snap ring 146 received within a groove defined within the support rod 140.

Returning to FIGS. 2-3, the base 40 is configured to be coupled to the marine vessel 1 with the top 42 facing the underside 10 of the deck 6. The base 40 may be coupled to the deck 6 using fasteners and brackets presently known in the art. A mounting bracket 60 is coupled via fasteners 62 (e.g., screws, nuts and bolts, or rivets) to the outward sides 48 of the sides 44 of the base 40. The mounting bracket 60 is receivable in a C-channel bracket or other hardware known in the art (not shown) that is coupled to the deck 6 and/or pontoons 12 to thereby couple the stowable propulsion device 30 thereto.

As shown in FIGS. 2-4, the stowable propulsion device 30 includes a shaft 230 that extends between a proximal end 232 and distal end 234 defining a length axis LA therebetween. The proximal end 232 of the shaft 230 is non-rotatably coupled to a moving gear 100. The moving gear 100 has a proximal face 102 and mesh face 104 having gear teeth, where the mesh face 104 engages with the mesh face 96 of the stationary gear 92 to together form a gearset 90 as discussed further below. The moving gear 100 further includes a barrel 106 that extends perpendicularly relative to the proximal face 102 and is coupled to the shaft 230 in a manner known in the art (e.g., via a set screw or welding). In this manner, the moving gear 100 is fixed to the shaft 230 such that rotation of the moving gear 100 causes rotation of the shaft 230 about the length axis LA.

Figure 5:
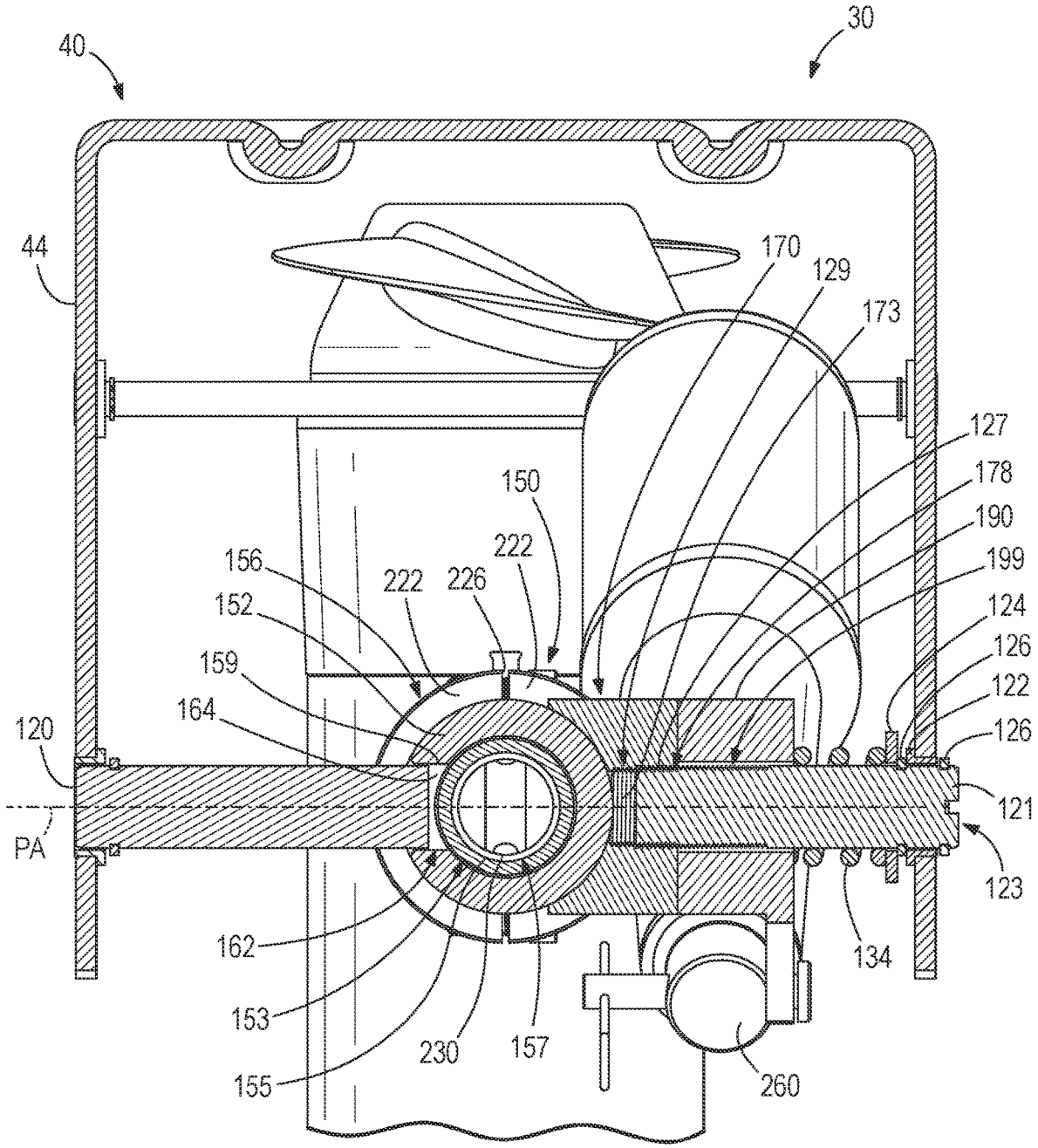
FIG. 5 is a sectional view taken along the line 5-5 of FIG. 2.
Figure 6:
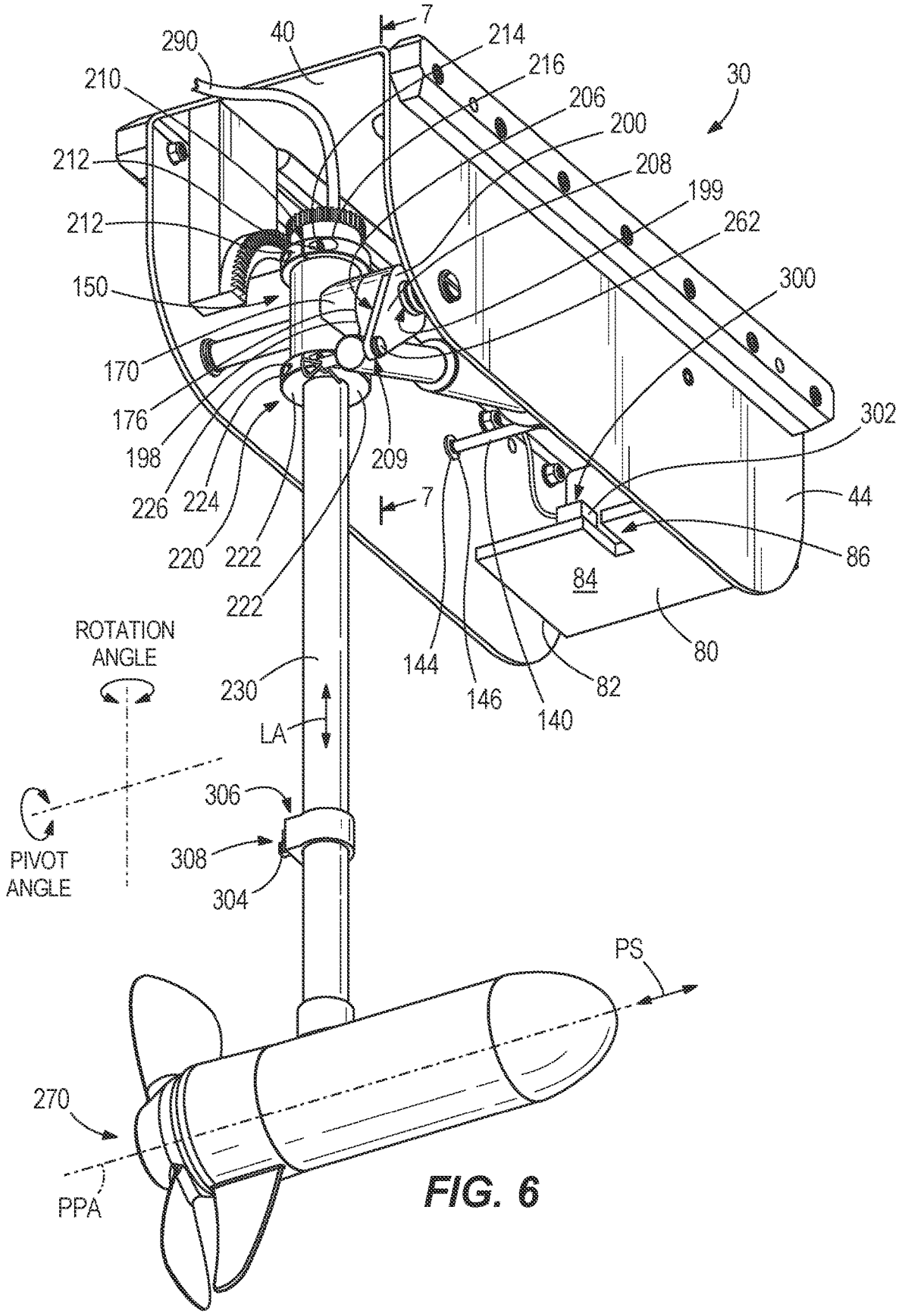
FIG. 6 is an isometric bottom view depicting the system of FIG. 2 in a deployed position.
Figure 7:
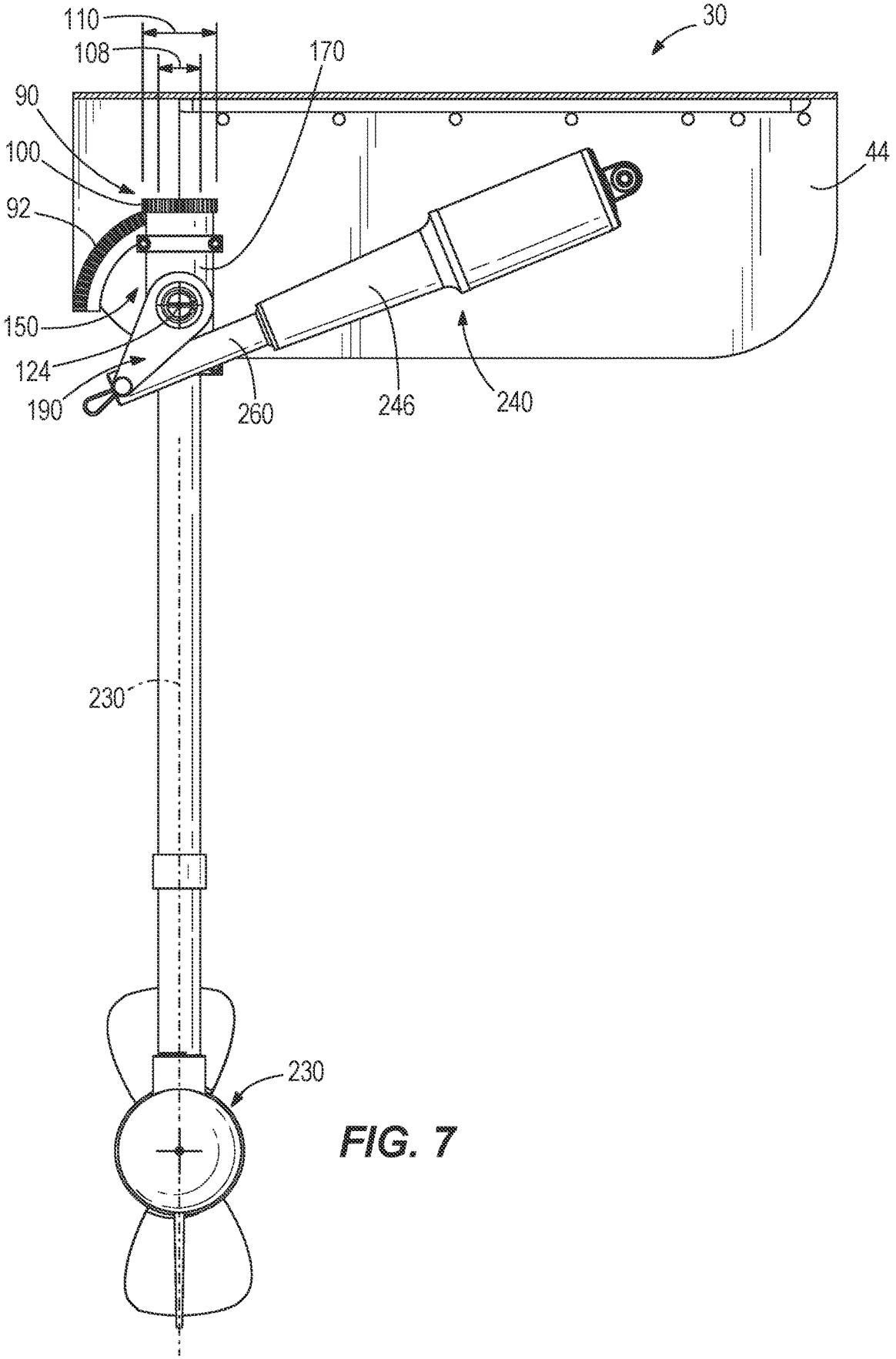
FIG. 7 is a sectional side view taken along the line 7-7 in FIG. 6.
Figure 8:
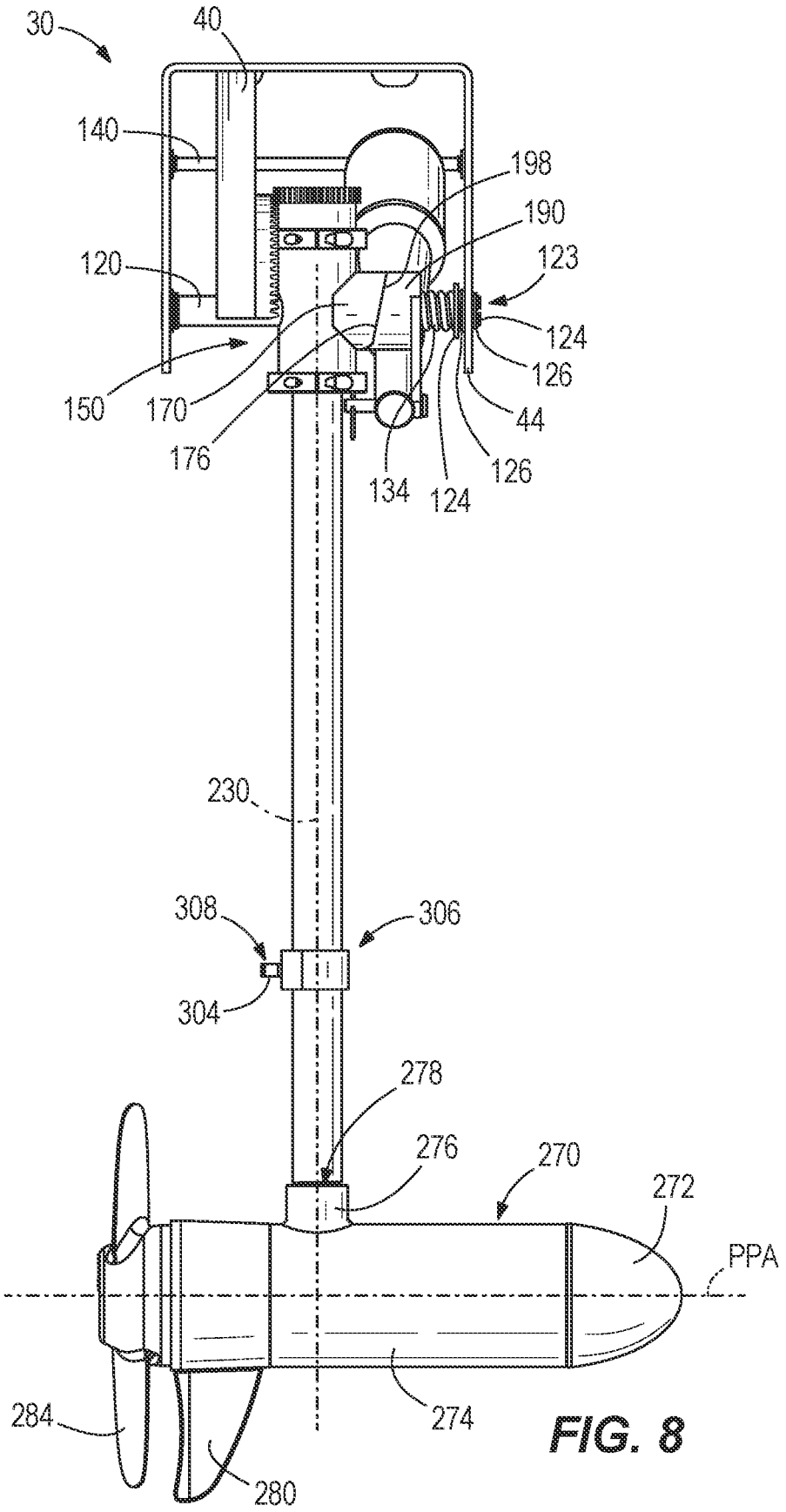
FIG. 8 is a rear view of the system of FIG. 6.

With reference to FIGS. 2 and 5-6, a pivot rotation device 150 is coupled to the shaft 230 near its proximal end 232, below the moving gear 100. The pivot rotation device 150 includes a main body 152 extending between a first end 154 and a second end 156 with an opening 153 defined therebetween. The shaft 230 is received through the opening 153 between the first end 154 and second end 156 of the main body 152 and rotatable therein. In the embodiment shown, a bushing 155 is received within the opening 153 of the main body 152 and the shaft 230 extends through an opening 157 within the bushing 155. The bushing 155 provides for smooth rotation between the shaft 230 and the main body 152. The shaft 230 is retained within the main body 152 via first and second clamp systems 210, 220. The first clamp system 210 includes two clamp segments 212 coupled together by fasteners 216 received within openings and receivers therein, for example threaded openings for receiving the fasteners 216. The clamp segments 212 are configured to clamp around the shaft 230 just above the main body 152, in the present example with a gasket 213 sandwiched therebetween to provide friction. Likewise, clamp segments 222 of the second clamp system 220 are coupled to each other via fasteners 226 to clamp onto the shaft just below the main body 152, which may also include a gasket sandwiched therebetween. In this manner, the shaft 230 is permitted to rotate within the main body 152, but the first and second clamp systems 210, 220 on opposing ends of the main body 152 prevent the shaft 230 from moving axially through the main body 152.

As shown in FIGS. 2-3 and 5, the shaft 230 is pivotable about a transverse axis (shown as pivot axis PA) formed by coaxially-aligned pivot axles 120, 121. The pivot axles 120, 121 are received within pivot axle openings 52 defined within the sides 44 of the base 40, with bushings 122 therebetween to prevent wear. Snap rings 126 are receivable within grooves defined 128 within the pivot axles 120, 121 to retain the axial position of the pivot axles 120, 121 within the base 40. The interior ends of the pivot axles 120, 121 are received within the main body 152 of the pivot rotation device 150 coupled to the shaft 230. The pivot axle 120 is received within a pivot axle opening 162 of the main body 152 such that the outer surface of the pivot axle 120 engages an interior wall 159 of the main body 152. In the embodiment of FIG. 5, a gap 164 remains at the end of the pivot axle 120 to allow for tolerancing and bending and/or movement of the sides 44 of the base 40.

With continued reference to FIG. 5, the pivot rotation device 150 further includes an extension body 170 that extends away from the main body 152. The extension body 170 defines a pivot axle opening 178 therein for receiving the pivot axle 121. The pivot axle 121 has an insertion end 129 with threads 127 defined thereon, which engage with threads 173 of the pivot axle opening 178 defined in the extension body 170. A slot 123 is defined in the end of the pivot axle 121 opposite the insertion end 129. The pivot axle 121 is therefore threadably received within the extension body 170 by rotating a tool (e.g., a flathead screwdriver) engaged within the slot 123 defined in the end of the pivot axle 121. A snap ring 126 may also be incorporated and receivable within grooves 128 defined in the pivot axle 121 to prevent axial translation of the pivot axle 121 relative to the sides 44 of the base 40.

As shown in FIG. 2, a face 176 of the extension body 170 defines a notch 177 recessed therein, which as will become apparent provides for non-rotational engagement with a pivot arm 190. The pivot arm 190 includes a barrel portion 192 having a face 198 with a protrusion 179 extending perpendicularly away from the face 198. The protrusion 179 is received within the notch 177 when the faces 176, 198 about each other to rotationally fix the pivot arm 190 and the extension body 170. It should be recognized that other configurations for rotationally fixing the pivot arm 190 and extension body 170 are also contemplated by the present disclosure, for example other keyed arrangements or fasteners.

The barrel portion 192 of the pivot arm 190 further defines a pivot axle opening 199 therethrough, which enables the pivot axle 121 to extend therethrough. The pivot arm 190 further includes an extension 200 that extends away from the barrel portion 192. The extension 200 extends from a proximal end 202 coupled to the barrel portion 192 to distal end 204, having an inward face opposite an outward face 208. A mounting pin opening 209 is defined through the extension 200 near the distal end 204, which as discussed below is used for coupling the pivot arm 190 to an actuator 240.

As shown in FIGS. 2 and 4, the pivot arm 190 is biased into engagement with the main body 152 of the pivot rotation device 150 via a biasing device, such as a spring 134. In the example shown, the spring 134 is a coil or helical spring that engages the outward face 208 of the extension 200 of the pivot arm 190 at one end and engages a washer 124 abutting a snap ring 126 engaged within a groove of the pivot axle 121 at the opposite end. In this manner, the spring 134 provides for a biasing force engaging the pivot arm 190 and the main body 152 such that the faces 176, 198 thereof remain in contact during rotation of the pivot arm 190, but also provides a safeguard. For example, if the shaft 230 experiences an impact force (e.g., a log strike), the presently disclosed configuration allows the protrusion 179 (shown here to have a rounded shape) to exit the notch 177 against the biasing force of the spring 134 to prevent the force from damaging other components, such as the actuator 240 coupled to the pivot arm 190 (discussed further below).

Referring to FIGS. 2-4, the stowable propulsion device 30 further includes an actuator 240 (presently shown is a linear actuator), which for example may be an electric, pneumatic, and/or hydraulic actuator presently known in the art. The actuator 240 extends between a first end 242 and second end 244 and has a stationary portion 246 and an extending member 260 that extends from the stationary portion 246 in a manner known in the art. The stationary portion 246 includes a mounting bracket 248 that is coupled to the base 40 via fasteners 252, such as bolts, for example. At the opposite end of the actuator 240, a mounting pin opening 261 extends through the extending member 260, which is configured to receive a mounting pin 262 therethrough to couple the extending member 260 to the pivot arm 190 of the pivot rotation device 150. The mounting pin 262 shown extends between a head 264 and an insertion end 266, which in the present example has a locking pin opening 268 therein for receiving a locking pin 269. The locking pin 269, for example a cotter pin, is inserted or withdrawn to removably retain the mounting pin 262 in engagement between the actuator 240 and the pivot arm 190. In the embodiment of FIGS. 2-4, it should be recognized that actuation of the actuator 240 thus causes pivoting of the shaft 230 about the pivot axis PA.

Referring to FIG. 2, the stowable propulsion device 30 further includes a propulsor 270 coupled to the distal end 234 of the shaft 230. The propulsor 270 may be of a type known in the art, such as an electric device operable by battery. In the example shown, the propulsor 270 includes a nose cone 272 extending from a main body 274. The main body 274 includes an extension collar 276 that defines a shaft opening 278, whereby the shaft 230 is received within the shaft opening 278 for coupling the shaft 230 to the propulsor 270. The propulsor 270 includes a motor 282 therein, whereby control and electrical power may be provided to the motor 282 by virtue of a wire harness 290 (FIG. 9, also referred to as a wire) extending through the shaft 230, in the present example via the opening 108 defined through the moving gear 100; however, it should be recognized that the wire harness 290 may enter the shaft 230 or propulsor 270 in other locations. In some configurations, the wire harness 290 also extends through a gasket 291 (FIG. 9) that prevents ingress of water or other materials into the shaft 230, for example. The propulsor 270 further includes a fin 280 and is configured to rotate the propeller 284 about a propeller axis PPA. The propulsor 270 extends a length 286 (FIG. 3) and provides propulsive forces in a direction of propulsion DOP. With reference to FIG. 4, the propulsor 270 has a width PW that is perpendicular to the length 286, in certain embodiments the width PW being less than the width 64 of the base 40.

As shown in FIG. 6 and discussed further below, the propulsor 270 is configured to propel the marine vessel 1 through the water in the port-starboard direction PS when the shaft 230 is positioned in the deployed position. It should be recognized that, for simplicity, the propulsor 270 is described as generating propulsion in the port-starboard direction, and thus that the marine vessel moves in the port-starboard direction. However in certain configurations, the propulsor 270 may accomplish this movement of the marine vessel in the port-starboard direction by concurrently using another propulsor coupled elsewhere on the marine vessel 1, for example to provide translation rather than rotation of the marine vessel 1.

It should be recognized that when transitioning the shaft 230 and propulsor 270 from the stowed position of FIG. 3 to the deployed position of FIG. 6, the shaft 230 pivots 90 degrees about the pivot axis PA from being generally horizontal to generally vertical, and the propulsor 270 rotates 90 degrees about the length axis LA of the shaft 230 from the propeller axis PPA being within the fore-aft plane FAP (FIG. 1) to extending in the port-starboard direction PS. The present inventors invented the presently disclosed stowable propulsion devices 30 wherein pivoting of the shaft 230 about the pivot axis PA automatically correspondingly causes rotation of the shaft 230 about is length axis LA without the need for additional actuators (both being accomplished by the same actuator 240 discussed above). With reference to FIGS. 2-3, this function is accomplished through a gearset 90, which as discussed above is formed by the engagement of the stationary gear 92 and moving gear 100.

As discussed above, the stationary gear 92 is fixed relative to the base 40 and the moving gear 100 rotates in conjunction with the shaft 230 rotating about its length axis LA. In this manner, as the shaft 230 is pivoted about the pivot axis PA via actuation of the actuator 240, the engagement between the mesh face 96 of the stationary gear 92 and the mesh face 104 of the moving gear 100 causes the moving gear 100 to rotate, since the stationary gear 92 is fixed in place. This rotation of the moving gear 100 thus causes rotation of the moving gear 100, which correspondingly rotates the shaft 230 about its length axis LA. Therefore, the shaft 230 is automatically rotated about its length axis LA when the actuator 240 pivots the shaft 230 about the pivot axis PA. It should be recognized that by configuring the mesh faces 96, 104 of the gears accordingly (e.g., numbers and sizes of gear teeth), the gearset 90 may be configured such that pivoting the shaft 230 between the stowed position of FIG. 4 and the deployed position of FIG. 6 corresponds to exactly 90 degrees of rotation for the shaft 230 about its length axis LA, whether or not the shaft 230 is configured to pivot 90 degrees between its stowed and deployed positions. It should be recognized that other pivoting and/or rotational angles are also contemplated by the present disclosure.

The present inventors invented the presently disclosed configurations, which advantageously provide for stowable propulsion devices 30 having a minimal width 64 (FIG. 2) when in the stowed position, clearing the way for use of a scissor type lift 20 or other lifting mechanisms for the marine vessel 1, while also positioning the propulsor for generating thrust in the port-starboard direction PS when in the deployed position.

As shown in FIG. 6, certain embodiments include stop 80 within the base 40 for stopping, centering, and/or securing the shaft 230 in the stowed position. In the embodiment shown, a centering slot 86 is defined within the bottom 84 of the stop 80. This centering slot 86 is configured to receive a tab 308 that extends from a clamp 306 positioned at a midpoint along the shaft 230. When the shaft 230 is pivoted and rotated into its stowed position as shown in FIG. 2, the tab 308 of the clamp 306 is received within the centering slot 86 of the stop 80, whereby the bottom 84 of the stop 80 itself prevents further upward pivoting of the shaft 230, and whereby the centering slot 86 prevents lateral movement of the propulsor 270 when in the stowed position.

The embodiment of FIG. 6 further depicts a positional sensor 300 configured for detecting whether the stowable propulsion device 30 is in the stowed position. The positional sensor 300 shown includes a stationary portion 302 and a moving portion 304, whereby the stationary portion 302 is a Hall Effect Sensor positioned adjacent to the centering slot 86 of the stop 80, which detects the moving portion 304 integrated within the tab 308. In this manner, the positional sensor 300 detects when the shaft 230 is properly in the stowed position, and when it is not.

It should be recognized that other positional sensors 300 are also known in the art and may be incorporated within the systems presently disclosed. For example, FIG. 3 depicts an embodiment in which the positional sensor 300 is incorporated within the actuator 240, such as a linear encoder, that can be used to infer the position of the shaft 230 via the position of the extending member 260 of the actuator 240 relative to the stationary portion 246. An exemplary positional sensor 300 is Mercury Marine's Position Sensor ASM, part number 8M0168637, for example.

Figure 9:
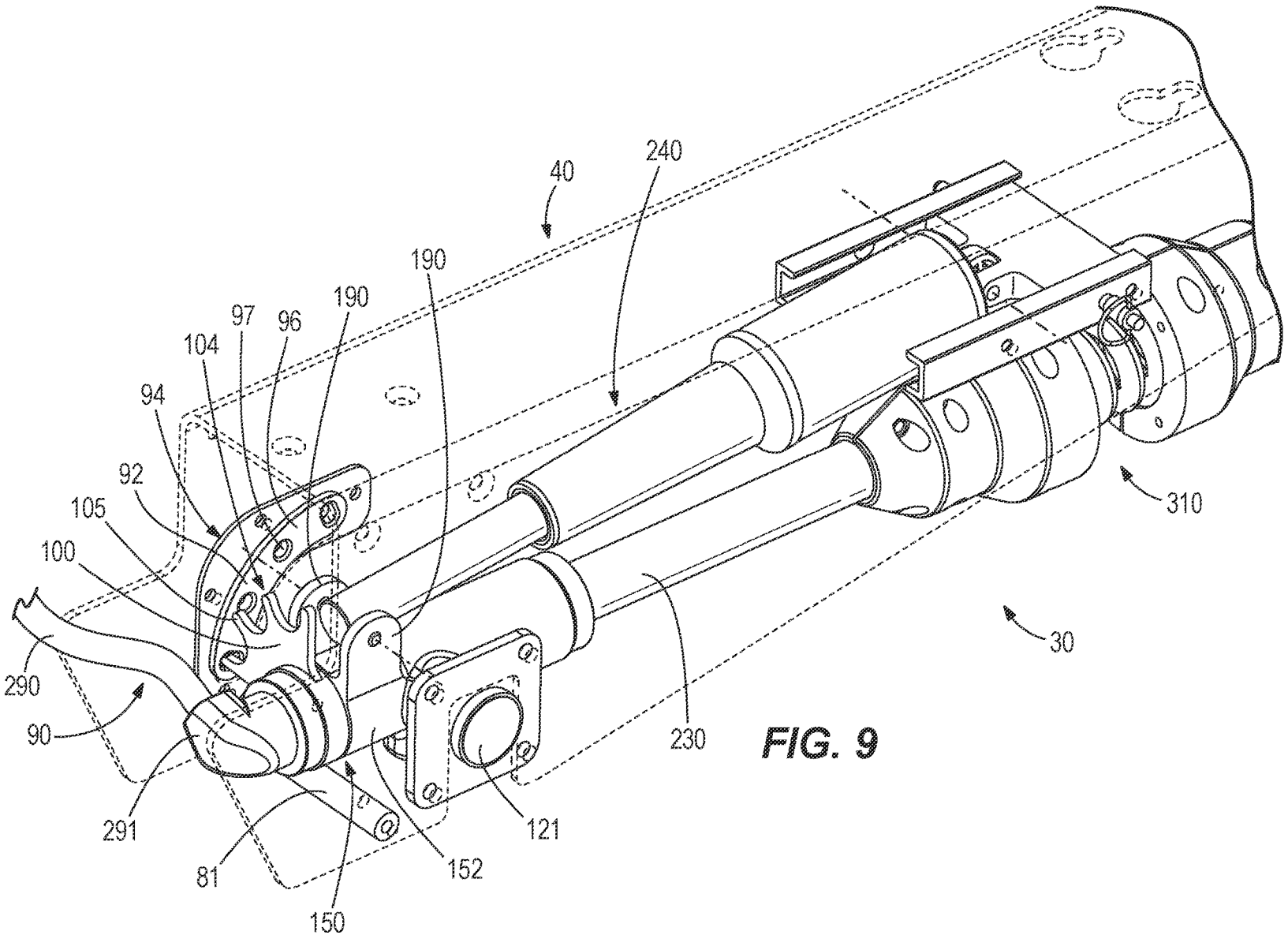
FIG. 9 is an isometric view of an alternate embodiment of system according to the present disclosure.

The present disclosure contemplates other embodiments of stowable propulsion devices 30. For example, FIG. 9 depicts an embodiment having two pivot arms 190 coupled directly to the main body 152 of the pivot rotation device 150. The actuator 240 is pivotally coupled to the two pivot arms 190 in a similar manner as that discussed above. In certain examples, the two pivot arms 190 are integrally formed with the clamp segments 212 of the first clamp system 210, for example. The gearset 90 of the embodiment in FIG. 9 also varies from that discussed above. Specifically, the mesh face 96 of the stationary gear 92 includes openings 97 rather than gear teeth. These openings 97 are configured to receive fingers 105 that extend from the mesh face 104 of the moving gear 100, generally forming a gear and sprocket type system for the gearset 90. The embodiment shown also includes a stop rod 81 for preventing the shaft 230 from rotating too far, or in other words past the deployed position.

Figure 10:
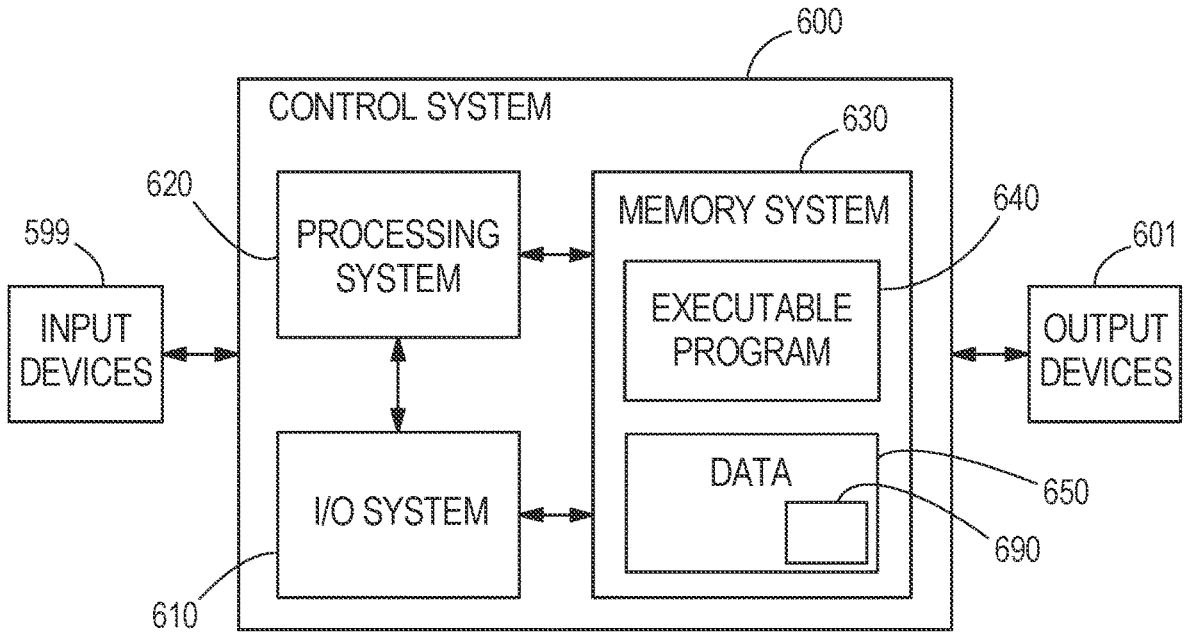
FIG. 10 depicts an exemplary control system for controlling stowable propulsion devices according to the present disclosure.

FIG. 10 depicts an exemplary control system 600 for operating and controlling the stowable propulsion device 30. Certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices. The connections between functional and logical block components are merely exemplary, which may be direct or indirect, and may follow alternate pathways.

In certain examples, the control system 600 communicates with each of the one or more components of the stowable propulsion device 30 via a communication link CL, which can be any wired or wireless link. The control system 600 is capable of receiving information and/or controlling one or more operational characteristics of the stowable propulsion device 30 and its various sub-systems by sending and receiving control signals via the communication links CL. In one example, the communication link CL is a controller area network (CAN) bus; however, other types of links could be used. It will be recognized that the extent of connections and the communication links CL may in fact be one or more shared connections, or links, among some or all of the components in the stowable propulsion device 30. Moreover, the communication link CL lines are meant only to demonstrate that the various control elements are capable of communicating with one another, and do not represent actual wiring connections between the various elements, nor do they represent the only paths of communication between the elements. Additionally, the stowable propulsion device 30 may incorporate various types of communication devices and systems, and thus the illustrated communication links CL may in fact represent various different types of wireless and/or wired data communication systems.

The control system 600 of FIG. 10 may be a computing system that includes a processing system 610, memory system 620, and input/output (I/O) system 630 for communicating with other devices, such as input devices 599 and output devices 601, either of which may also or alternatively be stored in a cloud 602. The processing system 610 loads and executes an executable program 622 from the memory system 620, accesses data 624 stored within the memory system 620, and directs the stowable propulsion device 30 to operate as described in further detail below.

The processing system 610 may be implemented as a single microprocessor or other circuitry, or be distributed across multiple processing devices or sub-systems that cooperate to execute the executable program 622 from the memory system 620. Non-limiting examples of the processing system include general purpose central processing units, application specific processors, and logic devices.

The memory system 620 may comprise any storage media readable by the processing system 610 and capable of storing the executable program 622 and/or data 624. The memory system 620 may be implemented as a single storage device, or be distributed across multiple storage devices or sub-systems that cooperate to store computer readable instructions, data structures, program modules, or other data. The memory system 620 may include volatile and/or non-volatile systems and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example.

The present disclosure further relates to impact protection for propulsion devices for marine vessels, including but not limited to the stowable propulsion devices described above. In particular, the present inventors have recognized that propulsion devices presently known in the art are vulnerable to strike events (e.g., impact forces of the propulsor 270 of FIG. 6 from striking a log or another underwater object). These impact forces may occur while the propulsor 270 is propelling the marine vessel, and/or while the marine vessel is otherwise moving through the water while the propulsor 270 remains in the water (e.g., via a stern-mounted outboard propulsor, or a strong current). With reference to FIG. 6, the present inventors have recognized that an impact force acting on the propulsor 270, the shaft 230, or the propulsion device 30 more generally can cause extensive damage to various parts of the propulsion device 30, including the pivot rotation device 150, pivot axles 120, 121, and/or the actuator 240. As such, the present inventors have recognized an unmet need to provide impact protection for propulsion devices such that impact forces can be absorbed and/or damage can be limited to lower cost and/or more easily replaced components. Additionally, the present inventors have recognized an unmet need for a propulsion device that remains at least partially functional after a strike event occurs.

Figure 11:
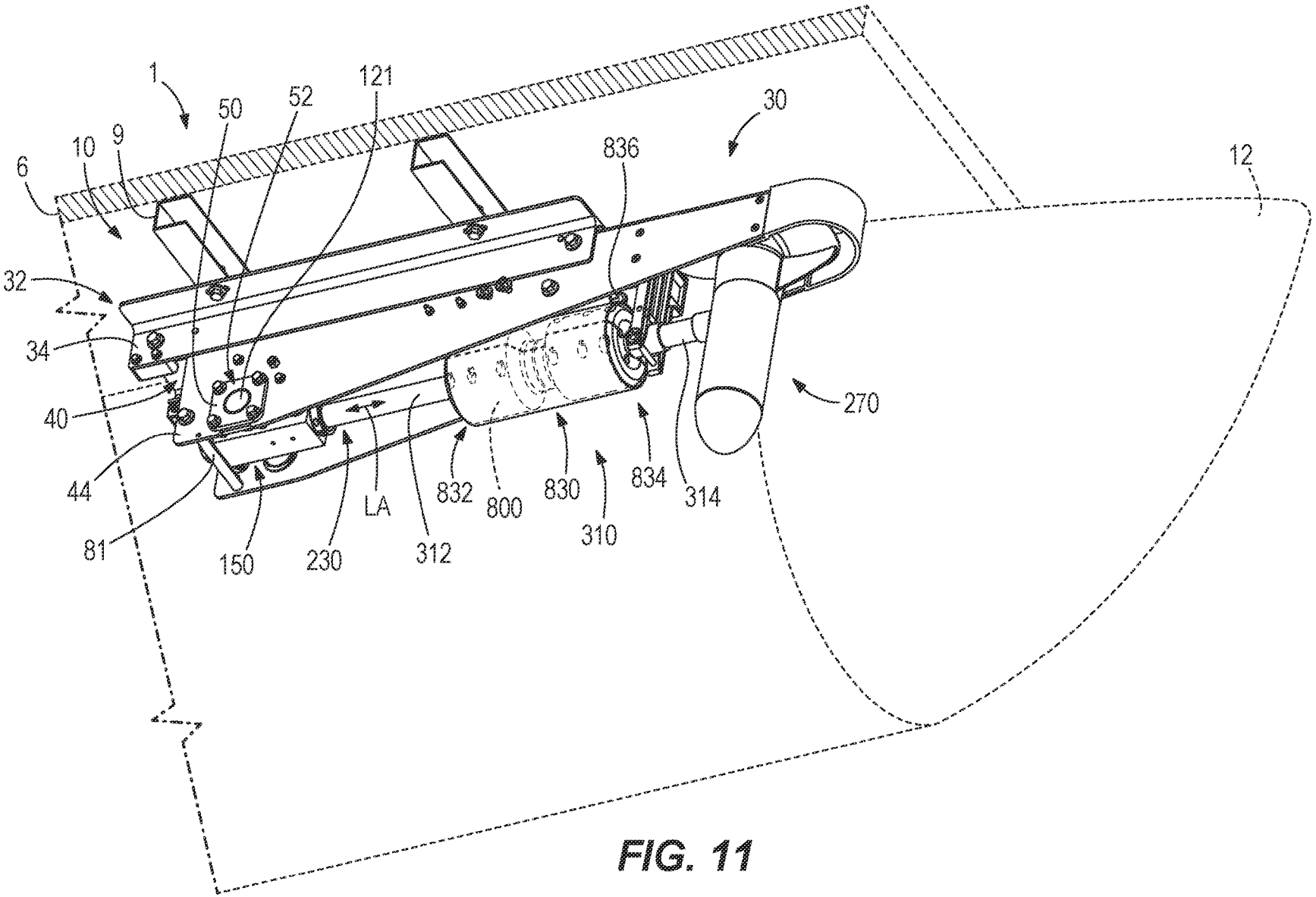
FIG. 11 depicts an isometric bottom view of another embodiment of a propulsion device incorporating impact protection according to the present disclosure.

FIG. 11 depicts one embodiment of a propulsion device, here a stowable propulsion device 30 similar to that discussed above but incorporating an shock absorber 310 according to the present disclosure. A base 40 is coupled to sides 34 of a mounting bracket 32, which is coupled to crossmembers 9 of the deck 6 for the marine vessel 1, for example using fasteners such as nuts and bolts. A shaft 230 is pivotally (and in this example, also rotatably) coupled to the base 40 via a pivot rotation device 150 in a manner described above. The shaft 230 is divided into an upper segment 312 and a lower segment 314 coupled together by an shock absorber 310 to form the shaft 230. The upper segment 312 and lower segment 314 each extend between an upper end and a lower end defining a length axis therebetween. In the example shown, the upper segment 312 and lower segment 314 are normally parallel and coaxially aligned. A propulsor 270 is coupled to the lower end of the lower segment 314 as described above.

The shock absorber 310 includes a cover 830 that extends between a first end 832 and second end 834. An opening 836 is defined through the cover 830, which in this case has a cylindrical shape corresponding to the shape of the components contained therein. The cover 830 provides protection for other elements within the shock absorber 310, for example shielding internal components from water, abrasion, and the like, and/or may serve as a decorative covering. Exemplary materials for the cover 830 include plastics, neoprene and other textiles, and/or aluminum, for example. The cover 830 may be fixed in place by attachment to the upper segment 312, lower segment 314, and/or other components within the shock absorber 310 in a manner known in the art (e.g., adhesives, hook and loop fasteners, threaded fasteners, and/or zip-ties).

Figure 12:
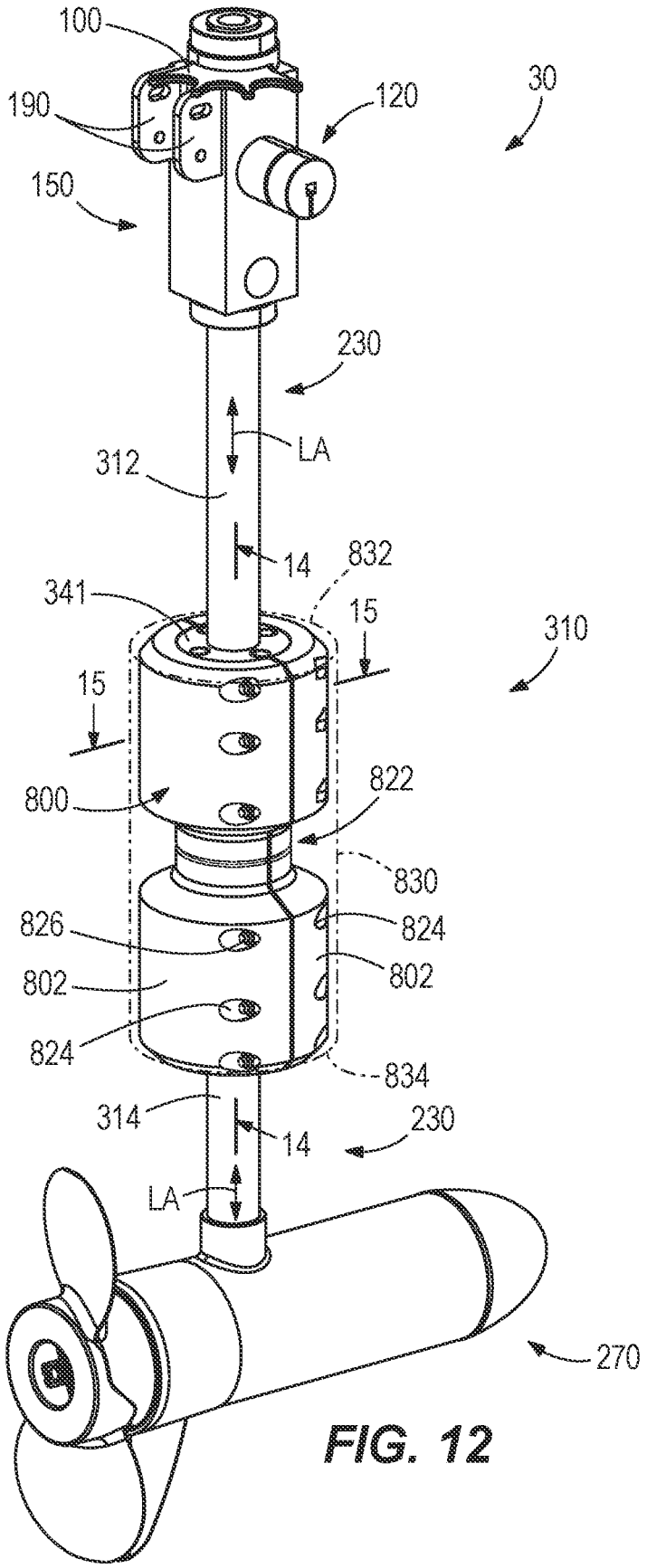
FIG. 12 is an isometric partial view of the propulsion device of FIG. 11 shown separately from the base and marine vessel.

FIG. 12 shows additional components of the shock absorber 310, including a breakaway sleeve 800 formed by coupling two shells 802 together, here via fasteners such as bolts 628 and nuts 828 extending through openings 824 in the shells 802. The breakaway sleeves 800 extends between a first end 804 and a second end 806 and defines an opening 808 therethrough for receiving the upper segment 312 and lower segment 314 of the shaft 230. The breakaway sleeve 800 has a recess or score line 822 extending into its outer surface. In the embodiment shown, the score line 822 is thinner and thus weaker than the opposing upper and lower segments 312, 214. Therefore, the breakaway sleeve 800 will break at the score line 822 when the length axes LA of the upper segment 312 and lower segment 314 are forced out of alignment with each other, such as when impact forces received by the lower segment 314 exceed a predetermined limit determined by the material and thickness of the score line 822. Exemplary materials for the breakaway sleeve 800 include delrins or nylons, which may be standard or fiber reinforced, for example. In certain examples, the predetermined limit at which the breakaway sleeve 800 is configured to break at the score line 822 is 200 pounds, though this limit may be greater or less based on the stowable propulsion device 30 (for example based on the components thereof), marine vessel 1 (for example the size and weight thereof), and/or the like. This predetermined limit is selected to withstand forces encountered during normal operation of the marine vessel 1, but break before the impact of an underwater strike event would damage elements of the stowable propulsion device 30, such as the actuator 240.

It should be recognized that other configurations for creating a score line 822 where the breakaway sleeve 800 will break are also contemplated by the present disclosure, including the use of different materials, different structural support, and/or heat treatment, to name a few.

Figure 13:
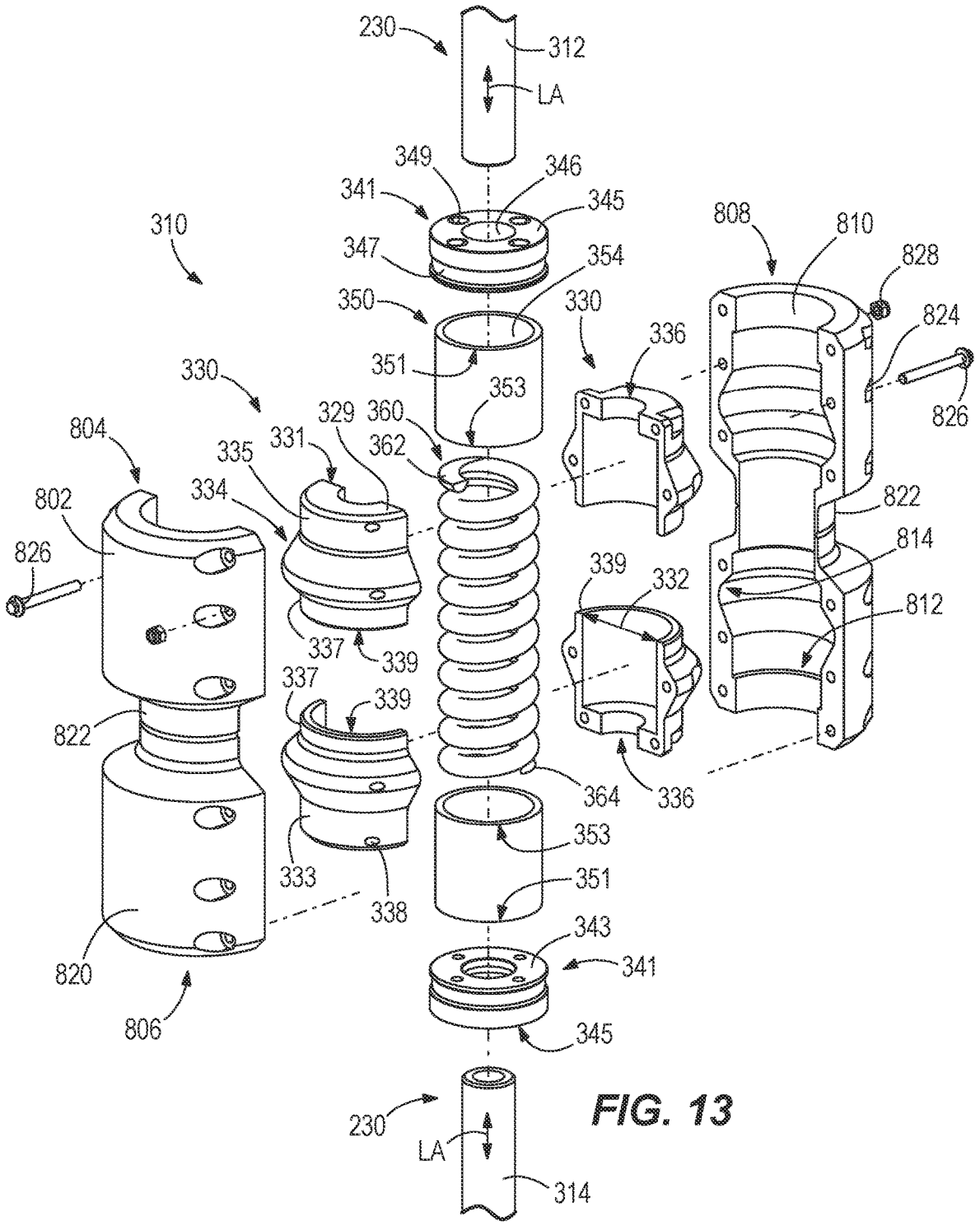
FIG. 13 is an exploded view of the impact protection system shown in FIG. 12.
Figure 14:
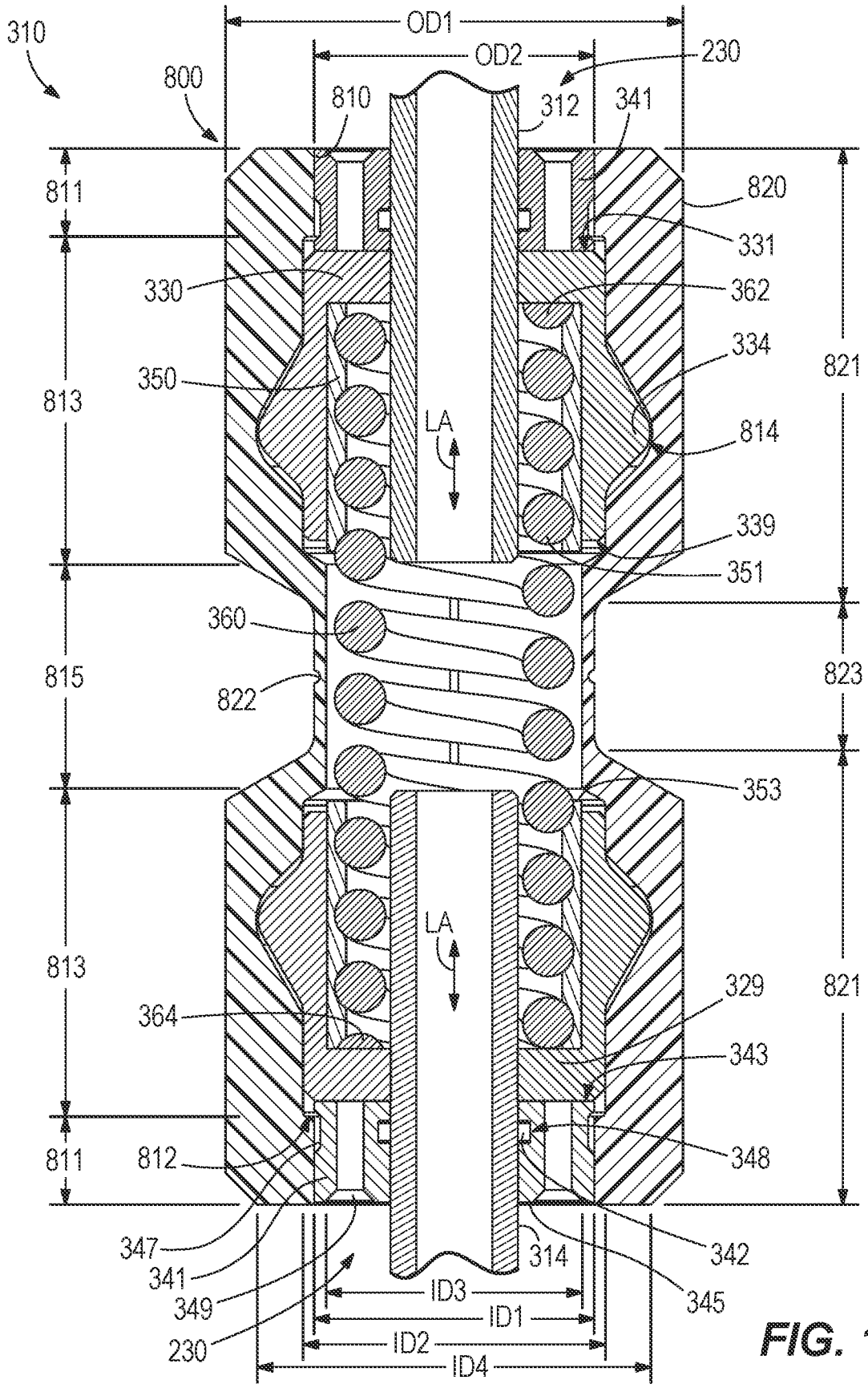
FIG. 14 is a sectional view taken along the line 14-14 in FIG. 12.

FIGS. 13-14 depict how the shock absorber 310 is coupled to the upper segment 312 and lower segment 314. In the example shown, a resilient member 360 couples the upper segment 312 and lower segment 314 of the shaft 230. In this embodiment, resilient member 360 is a helical spring having a first end 362 engaged with the upper segment 312 and a second end 364 engaged with the lower segment 314. The resilient member 360 resiliently couples the upper and lower segments 312, 314 together to resist non-coaxial alignment of the respective length axes LA, resist rotation of the lower segment 314 relative to the upper segment 312, and dampen for the upper segment 312 impact forces received at the lower segment 314. It should be recognized that other forms of resilient members 360 are also contemplated by the present disclosure, including resilient rods (e.g., elongated rubber cylinders such as those used in propeller hubs extending between the upper segment 312 and lower segment 314 or other elastomer materials having appropriate properties and attributes, for example.

In the example of FIGS. 13-14, sleeves 350 radially surround the resilient member 360 to sandwich the resilient member 360 between the sleeves 350 and the upper segment 312 and lower segment 314, as the case may be. The sleeves 350 extend from a first end 351 to a second end 353 defining an opening 354 with an interior diameter 352 therethrough. The resilient member 360 is received within the opening 354 of the resilient member coupler 350, and thus the interior diameter 352 is selected to correspond to the outer diameter of the resilient member 360. Exemplary sleeves 350 include resilient materials such as natural or synthetic rubber.

With continued reference to FIGS. 13-14, clamps 330 radially surround and are clamped onto the sleeves 350. In this manner, the sleeves 350 are sandwiched between the clamps 330 and the resilient member 360. The clamps 330 are also coupled together to the shells 802 of the breakaway sleeve 800, for example via fasteners received through fastener openings 338 (e.g., nuts and bolts, threaded fasteners received within threaded openings, and/or the like). Each of the clamps 330 extends between a first end 331 having a floor 329 and second end 339. A shaft opening 336 is defined through the floor 329 and configured to receive the shaft 230 therein when two clamps 330 are clamped together around the shaft 230. The floor 329 retains the first and second ends 362, 364 of the resilient member 360 within the interior of the clamps 330. In certain embodiments, the first and second ends 362, 364 of the resilient member 360 also or alternatively engage with the upper segment 312 and lower segment 314 (e.g., being received within slots or openings therein) to limit the movement of the first and second ends 362, 364 relative to the upper segment 312 and lower segment 314.

Figure 15:
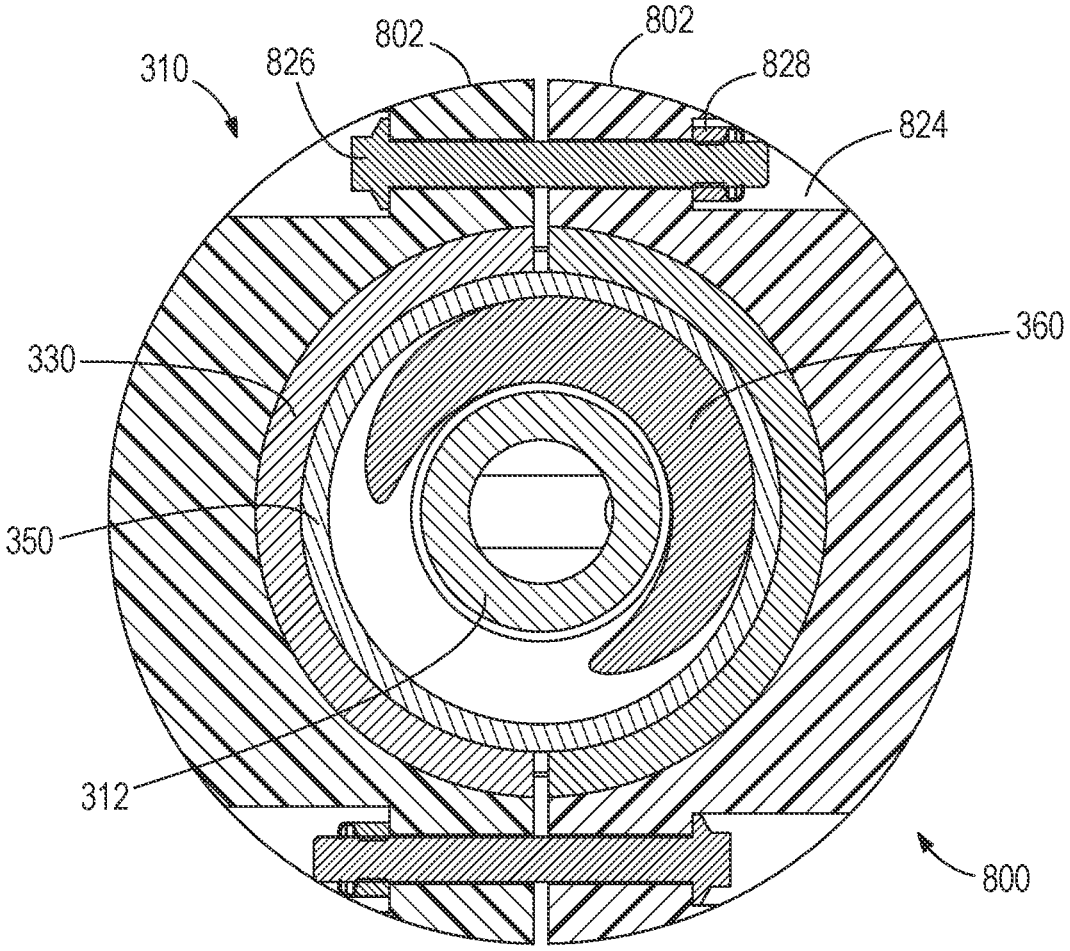
FIG. 15 is a sectional view taken along the line 15-15 in FIG. 12.

The exterior surface 333 of each clamp includes a first cylindrical segment 335 and a second cylindrical segment 337 with a protrusion 334 therebetween that extends radially outwardly. In this manner, the clamps 330 compress against the shaft 230 to translationally and rotationally fix the clamps 330 thereto. Likewise, the clamps 330 compress the sleeves 350 against the resilient member 360 to translationally and rotationally fix the clamps 330 relative to the resilient member 360. In this manner, the first end 362 of the resilient member 360 is translationally and rotationally fixed relative to the upper segment 312, and the second end 364 of the resilient member 360 is translationally and rotationally fixed relative to the lower segment 314. FIG. 15 shows this configuration as a top-down sectional view, also including the breakaway sleeve 800 surrounding the clamps 330 as discussed further below.

Returning to FIGS. 13-14, plugs 341 are positioned above and below the clamps 330, specifically between the breakaway sleeve 800 and the shaft 230. The plugs 341 have a first face 343 facing towards from the resilient member 360 and a second face 345 facing away from the resilient member 360. An opening 346 is defined through each of the plugs 341, sized and shaped to correspond to the shaft 230 to be received therethrough. As shown in FIG. 14, the plugs 341 further define an outer groove 347 and an inner groove 348 within outer and inner surfaces thereof, respectively. The inner groove 348 (FIG. 14) is configured to receive a seal 342 (e.g., an O-ring) therein to seal between the shaft 230 and the plug 341. The seal 342 may be configured to prevent debris and/or water from entering the shock absorber 310, such as to prevent ingress into the propulsor 270 (see e.g., FIG. 6) via the lower segment 314. In certain embodiments, the plug 341 is comprised of a resilient material to provide sealing with the breakaway sleeve 800 and with the shaft 230 without additional seals.

The plug 341 of FIG. 14 further defines openings 349 therethrough, which may be used to couple the plug 341 to the clamps 330. For example, a fastener may be inserted through the openings 349 and received within corresponding threaded openings (not shown) defined in the first ends 331 of the clamps 330 in a manner known in the art. Other mechanisms for fixing the position of the plugs 341 relative to the shaft 230 are also contemplated, including solely though compression by the breakaway sleeve 800.

As shown in FIG. 14, the outer grooves 347 of the plugs 341 also prevent the plugs 341 from moving axially along the shaft 230, specifically by engaging with a shelf 812 of the breakaway sleeve 800, as discussed further below. The breakaway sleeve 800 has an inner face 810 that extends along first regions 811 configured to engage with the plugs 341, second regions 813 configured to engage with the clamps 330, and a third region 815 between the second regions 813 that includes the gap between the upper segment 312 and lower segment 314 of the shaft 230. An first interior diameter ID1 is formed within the first region 811 when the shells 802 of the breakaway sleeve 800 are coupled together, as well as a second interior diameter ID2 for the second region 813 and third interior diameter ID3 for the third region 815. The shelf 812 of the inner face 810 is formed by the first interior diameter ID1 being smaller than the second interior diameter ID2. The shelf 812 is thus received within the outer groove 347 of the plug 341 to prevent axial movement thereof. As discussed above, a recess 814 is also defined within the inner face 810 of the breakaway sleeve 800 and configured to receive the protrusion 334 of the clamps 330 therein to prevent axial movement thereof. A fourth interior diameter ID4 is defined between the recesses 814, which in the present embodiment is greater than the first interior diameter ID1, second diameter ID2, and third diameter ID3; however, it should be recognized that alternate configurations are contemplated by the present disclosure.

With continued reference to FIG. 14, the breakaway sleeve 800 also has an outer face 820 extending between the first end 804 and second end 806, specifically in first regions 821 and a second region 823 therebetween. In the embodiment shown, a first outer diameter OD1 corresponding to the first regions 821 is greater than a second outer diameter OD2 corresponding to the second region 823. As discussed above, the breakaway sleeve 800 has a recess or score line 822 defined within the outer face 820, here specifically within the second region 823. The breakaway sleeve 800 and its score line 822 are configured such that an impact force imparted on the lower segment 314 causes the breakaway sleeve 800 to break at the score line 822 if exceeding a predetermined force. In certain embodiments, the material of the breakaway sleeve 800 and/or its construction provide some amount of resilience before breaking, thereby dampening for the upper segment 312 impact forces imposed on the lower segment 314 before this predetermined force is exceeded.

Figure 16:
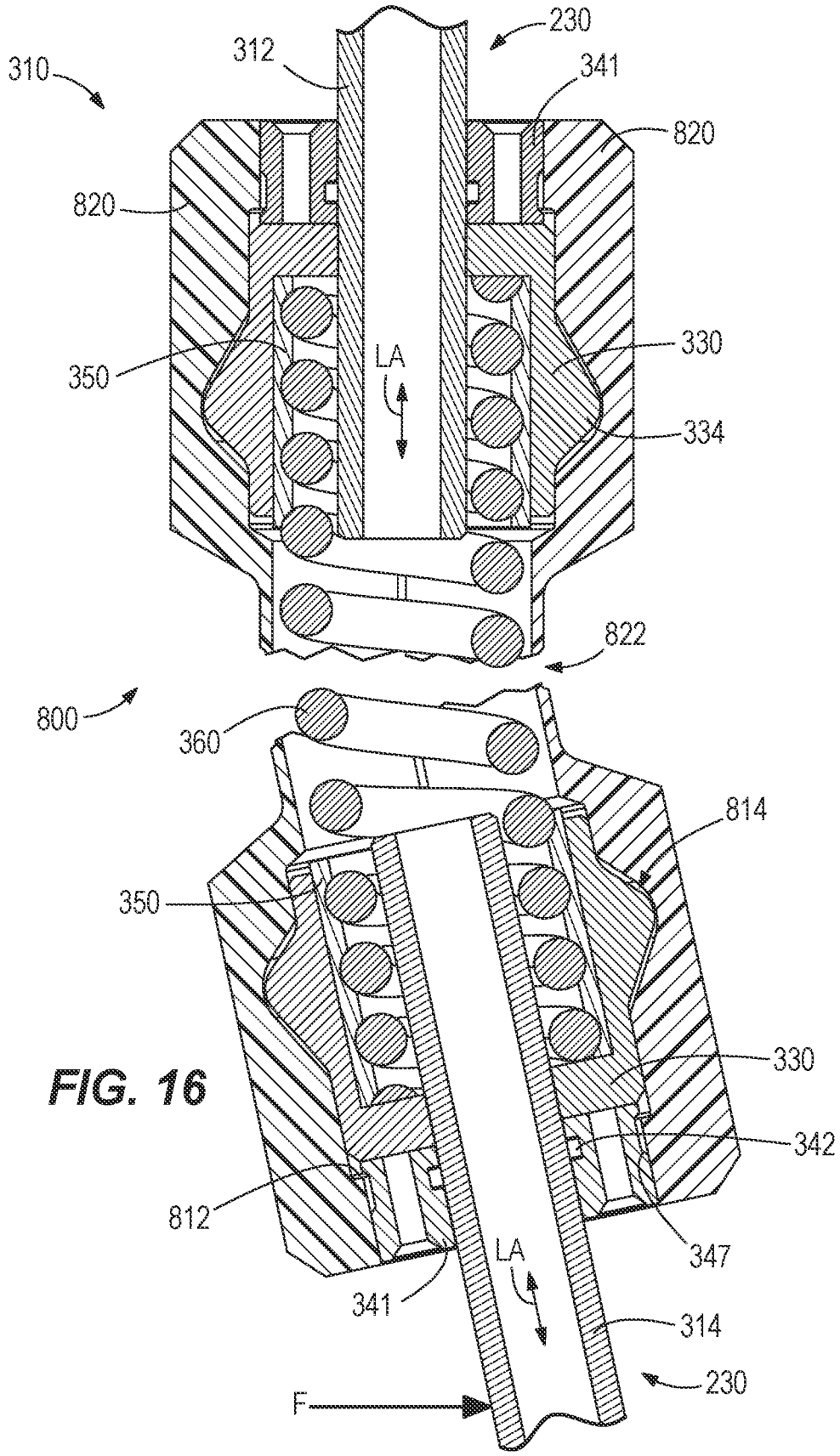
FIG. 16 is a section view taken along the line 14-14 in FIG. 12, shown providing impact protection from an impact force.

FIG. 16 shows an impact force F being applied to the lower segment 314 of the shaft 230, here exceeding the predetermined force and causing the breakaway sleeve 800 to break at the score line 822. Once the breakaway sleeve 800 has broken, the upper segment 312 and lower segment 314 remain coupled by the resilient member 360 since the first regions 821 of the shells 802 remain coupled together for the upper segment 312 and for the lower segment 314, respectively. In this manner, the shock absorber 310 before breaking prevents or resists the length axes LA of the upper segment 312 and lower segment 314 from translationally or rotationally moving relative to each other. In the embodiment shown, the shock absorber 310 not only resists the upper segment 312 and lower segment 14 from being non-parallel, but also being non-coaxial. Once the breakaway sleeves 802 breaks, the resilient member 360 continues to resist translational and rotational movement between the upper segment 312 and lower segment 314, but allows some play without the breakaway sleeve 800 being intact. However, even with additional play, the present inventors have recognized that the presently disclosed shock absorber 310 advantageously allows the user to achieve limited use of the propulsor 270 (see FIG. 11) even after the breakaway sleeve 800 has broken.

In certain examples, the breakaway sleeve is a replaceable shell that encases resilient member 360, for example as if the resilient member 360 had a dipped plastic coating. This shell makes the resilient member 360 rigid until the shell breaks. The shell can then be replaced with another to make the resilient member 360 rigid again. The shell may have two halves (i.e., clam shells) that define a helical interior for receiving the resilient member 360, whereby the halves are affixed together around the resilient member 360 using fasteners such as nuts and bolts, screws, adhesives, zip-ties, and/or the like.

Figure 17:
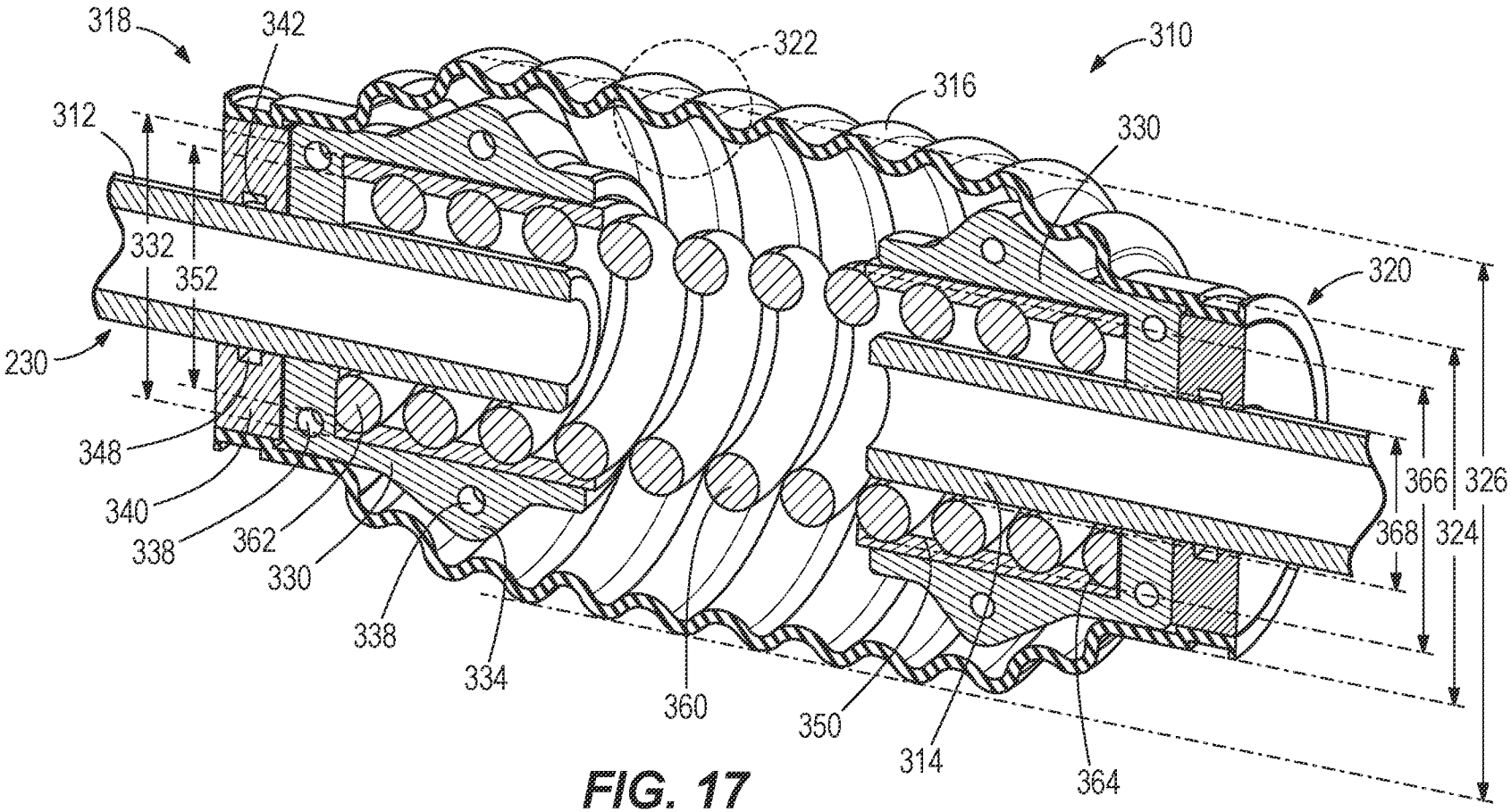
FIG. 17 is an isometric sectional view similar to the view of FIG. 14, showing another embodiment of a propulsion device incorporating impact protection according to the present disclosure.

It should be recognized that other embodiments according to the present disclosure do not provide a sacrificial element such as the breakaway sleeve 800, such as the shock absorber 310 shown in FIG. 17. Similar to the shock absorber 310 discussed above, FIG. 17 depicts an shock absorber 310 provided along the shaft 230 to protect elements of the propulsion device (such as the actuator 240 of FIG. 6) from damage caused by log strikes and other incidental collisions by the propulsor 270. Like the embodiment of FIGS. 11-16, the example of FIG. 17 includes a shaft 230 that is divided into an upper segment 312 and lower segment 314. Clamps 330 having internal diameters 332 are non-rotatably coupled to the upper segment 312 and lower segment 314 via fasteners received within fastener openings 338, which may be threaded to receive threaded bolts, for example. Each clamp 330 further includes a protrusion 334, as discussed below. Sealing caps 340 are positioned adjacent to the clamps 330 and include inner grooves 348 for receiving seals 342, such as O-rings, therein. This provides for a water-tight sealing between the upper segment 312 and lower segment 314 and the respective clamps 330.

Sleeves 350 having internal diameters 352 are received within the internal diameter 332 of the clamps 330 and function as described above. The sleeves 350 may be made of a rubber or plastic material known in the art, for example. The sleeves 350 are configured to retain a resilient member 360 between the shaft 230 and the internal diameters 332 of the clamps 330, such as through a tight press fit configuration. In certain embodiments, adhesives or other mechanisms are provided to support coupling between the resilient member 360 and resilient member coupler 350, and/or between the resilient member coupler 350 and the clamp 330.

With continued reference to FIG. 17, the resilient member 360 in the present embodiment is a helical spring extending between a first end 362 and a second end 364. The resilient member 360 includes an outer diameter 366 generally corresponding to the inner diameter 352 of the resilient member coupler 350. The resilient member 360 further includes an internal diameter 368 that generally corresponds to diameters of the upper segment 312 and lower segment 314. In this manner, by affixing the clamps 330 to the upper segment 312 and lower segment 314, the resilient member 360 provides for some amount of resilience (e.g., flexing and/or rotation) between the upper segment 312 and lower segment 314. This resilience accommodates the movement that would occur in the case of a log strike or other accidental collision, while still generally fixing the upper segment 312 and lower segment 314. The configuration also provides a conduit within the interiors of the upper segment 312 and lower segment 314 for receiving the wire harness 290 previously discussed with respect to FIG. 2.

The embodiment of FIG. 17 further includes a cover 316 provided over the clamps 330 to provide water sealing and general protection of the internal components previously discussed. The cover 316 extends between a first end 318 and second end 320 and has a ribbed profile 322. The cover 316 also varies from a first diameter 324 substantially near the first end 318 and the second end 320, and a larger second diameter 326 at a position therebetween. The ribbed profile 322 and the differing first diameter 324 and second diameter 326 provide for axial retention of the cover 316 relative to the clamps 330, specifically be engaging with the protrusions 334 extending from the clamps 330. In other words, the protrusions 334 engage with the inner side of the ribbed profile 322 of the cover 316 to prevent axially movement of the cover 316 relative to the upper segment 312 and lower segment 314. Collectively, the shock absorber 310 thereby provides for semi-rigid coupling of the upper segment 312 and lower segment 314, also in a watertight manner.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A propulsion device for a marine vessel, the propulsion device comprising:

a base configured to be coupled to the marine vessel;

a shaft comprised of an upper segment and a lower segment each extending along a length axis, wherein the upper segment is coupled to the base;

a propulsor coupled to the lower segment, wherein the propulsor is configured to propel the marine vessel in water;

a shock absorber comprising a resilient member that resiliently couples the upper segment and the lower segment together, wherein the resilient member dampens impact forces received at the lower segment and reduces transfer of the impact forces to the upper segment; and a pair of clamps that clamp together to sandwich the resilient member between the pair of clamps and one of the upper segment and the lower segment of the shaft to thereby couple the resilient member thereto.

2. The propulsion device according to claim 1, further comprising a wire that extends through the upper segment and the lower segment to provide power to the propulsor.

3. The propulsion device according to claim 1, further comprising a plug that seals between the pair of clamps and the one of the upper segment and the lower segment to prevent water from entering the propulsor via the shock absorber.

4. The propulsion device according to claim 1, further comprising a cover that extends along the length axis and surrounds the resilient member to prevent water from entering the propulsor via the shock absorber.

5. A propulsion device for a marine vessel, the propulsion device comprising:

a base configured to be coupled to the marine vessel;

a shaft comprised of an upper segment and a lower segment each extending along a length axis, wherein the upper segment is coupled to the base;

a propulsor coupled to the lower segment, wherein the propulsor is configured to propel the marine vessel in water; and a shock absorber comprising a resilient member that resiliently couples the upper segment and the lower segment together, wherein the resilient member dampens impact forces received at the lower segment and reduces transfer of the impact forces to the upper segment;

wherein the shock absorber further comprises a breakaway sleeve extending between an upper end and a lower end, wherein the upper end of the breakaway sleeve is coupled to the upper segment and the lower end of the breakaway sleeve is coupled to the lower segment, wherein the breakaway sleeve is configured to break when impact forces received by the lower segment exceed a predetermined limit.

6. The propulsion device according to claim 5, wherein a recess is defined circumferentially around the breakaway sleeve, and wherein the breakaway sleeve is configured to break at the recess when the impact forces received by the lower segment exceed the predetermined limit.

7. The propulsion device according to claim 6, wherein when the breakaway sleeve is coupled to the upper segment and the lower segment the recess is positioned therebetween.

8. The propulsion device according to claim 5, wherein the breakaway sleeve is formed by two shell sections configured to be coupled together to sandwich the upper segment and the lower segment therebetween.

9. The propulsion device according to claim 5, further comprising a collar configured to be sandwiched between the breakaway sleeve and the upper segment, wherein the collar is configured to prevent movement of the breakaway sleeve relative to the upper segment.

10. The propulsion device according to claim 9, wherein the collar is also configured to be sandwiched between the breakaway sleeve and the helical spring.

11. The propulsion device according to claim 10, wherein the breakaway sleeve has an inner surface that defines a recess therein, wherein the collar has an inner surface and an outer surface, wherein protrusions are formed on the inner surface that engage with the helical spring, and wherein protrusions are formed on the outer surface and engage with the recess defined in the breakaway sleeve.

12. The propulsion device according to claim 11, wherein the upper segment is pivotally coupled to the base.

13. The propulsion device according to claim 12, further comprising an actuator operatively coupled between the shaft and the base, wherein operating the actuator causes the upper segment to pivot, and further comprising a gearset coupled between the shaft and the base, wherein the gearset rotates the shaft about the length axes of the upper segment and the lower segment when the upper segment is pivoted.

14. A method for making a propulsion device for a marine vessel, the method comprising:

configuring a base for coupling to the marine vessel;

coupling a shaft to the base, the shaft comprising an upper segment and a lower segment each extending along a length axis, wherein the upper segment is coupled to the base;

coupling a propulsor to the lower segment, wherein the propulsor is configured to propel the marine vessel in water; and coupling the upper segment to the lower segment via a resilient member of a shock absorber, wherein the resilient member dampens impact forces received at the lower segment and reduces transfer of the impact forces to the upper segment, and wherein at least one of the upper segment and the lower segment is coupled to the resilient member by clamping a pair of clamps together to sandwich the resilient member between the pair of clamps and the at least one of the upper segment and the lower segment to thereby couple the resilient member thereto.

15. A method for making a propulsion device for a marine vessel, the method comprising:

configuring a base for coupling to the marine vessel;

coupling a shaft to the base, the shaft comprising an upper segment and a lower segment each extending along a length axis, wherein the upper segment is coupled to the base;

coupling a propulsor to the lower segment, wherein the propulsor is configured to propel the marine vessel in water;

coupling the upper segment to the lower segment via a resilient member of a shock absorber, wherein the resilient member dampens impact forces received at the lower segment and reduces transfer of the impact forces to the upper segment; and coupling a breakaway sleeve of the shock absorber to the upper segment and the lower segment, wherein the breakaway sleeve is configured to break when impact forces received by the lower segment exceed a predetermined limit.

16. The method according to claim 15, wherein a recess is defined circumferentially around the breakaway sleeve, and wherein the breakaway sleeve is configured to break at the recess when the impact forces received by the lower segment exceed the predetermined limit.

17. The method according to claim 15, wherein the breakaway sleeve is formed by two shell sections configured to be coupled together to sandwich the upper segment and the lower segment therebetween.

18. The method according to claim 15, wherein the resilient member comprises a helical spring, further comprising sandwiching a collar between the breakaway sleeve and the upper segment, wherein the collar is configured to prevent movement of the breakaway sleeve relative to the upper segment, wherein the breakaway sleeve has an inner surface that defines a recess therein, wherein the collar has an inner surface and an outer surface, wherein protrusions are formed on the inner surface that engage with the helical spring, and wherein protrusions are formed on the outer surface and engage with the recess defined in the breakaway sleeve.

19. The method according to claim 14, wherein the upper segment is pivotally coupled to the base, further comprising coupling an actuator between the upper segment and the base such that operating the actuator causes the upper segment to pivot, and further comprising coupling a gearset between the upper segment and the base such that the gearset rotates the shaft about the length axes of the upper segment and the lower segment when the upper segment is pivoted.

20. A propulsion device for a marine vessel, the propulsion device comprising:

a base configured to be coupled to the marine vessel;

a shaft comprised of an upper segment and a lower segment each extending along a length axis, wherein the upper segment is coupled to the base;

a propulsor coupled to the lower segment, wherein the propulsor is configured to propel the marine vessel in water;

a helical spring that resiliently couples the upper segment and the lower segment together, wherein the resilient member resists the length axes of the upper segment and the lower segment being non-parallel to each other, resists rotation of the lower segment relative to the upper segment, and dampens impact forces received at the lower segment and reduces transfer of the impact forces to the upper segment; and a breakaway sleeve that rigidly couples the upper segment and the lower segment, wherein the breakaway sleeve is configured to break when the impact forces received by the lower segment exceed a predetermined limit;

wherein the upper segment and the lower segment remain coupled together by the helical spring after the breakaway sleeve breaks.

* * * * *